US008033584B2

(12) United States Patent
Akizuki et al.

(10) Patent No.: US 8,033,584 B2
(45) Date of Patent: Oct. 11, 2011

(54) OPENING/CLOSING DEVICE FOR VEHICLE DOOR

(75) Inventors: Ryujiro Akizuki, Kariya (JP); Kimito Shimizu, Anjo (JP); Takashi Nishio, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 12/677,740

(22) PCT Filed: Nov. 19, 2008

(86) PCT No.: PCT/JP2008/071055

§ 371 (c)(1),
(2), (4) Date: Mar. 11, 2010

(87) PCT Pub. No.: WO2009/066708

PCT Pub. Date: May 28, 2009

(65) Prior Publication Data

US 2010/0194122 A1 Aug. 5, 2010

(30) Foreign Application Priority Data

Nov. 22, 2007 (JP) ..... 2007-303198

(51) Int. Cl.
*E05C 3/16* (2006.01)
*E05C 3/06* (2006.01)

(52) U.S. Cl. ..... 292/216; 292/201; 292/DIG. 23

(58) Field of Classification Search ..... 292/216, 292/201, DIG. 23, 215
See application file for complete search history.

(56) References Cited

U.S. PATENT DOCUMENTS

| | | | | |
|---|---|---|---|---|
| 5,918,917 | A * | 7/1999 | Elton et al. | 292/201 |
| 6,131,337 | A | 10/2000 | Machida | |
| 6,550,825 | B2 * | 4/2003 | Ostrowski et al. | 292/199 |
| 6,637,783 | B2 | 10/2003 | Takamura | |
| 6,698,804 | B2 | 3/2004 | Shiota et al. | |
| 7,175,212 | B2 * | 2/2007 | Cetnar et al. | 292/216 |
| 2003/0067175 | A1 | 4/2003 | Shiota et al. | |
| 2007/0120378 | A1 | 5/2007 | Hayakawa et al. | |

FOREIGN PATENT DOCUMENTS

| | | | |
|---|---|---|---|
| DE | 199 17 808 | A1 | 11/1999 |
| DE | 102 47 019 | A1 | 5/2003 |

(Continued)

OTHER PUBLICATIONS

International Search Report issued by the International Searching Authority (Japanese Patent Office) on Jan. 16, 2009 in International Application No. PCT/JP2008/071055. Supplementary Search Report issued on Nov. 4, 2010, by the European Patent Office in corresponding European Patent Application No. 08852751.
International Preliminary Report on Patentability issued Jun. 8, 2010 by the International Bureau of WIPO in International Application No. PCT/JP2008/071055.

*Primary Examiner* — Carlos Lugo
*Assistant Examiner* — Mark Williams
(74) *Attorney, Agent, or Firm* — Buchanan Ingersoll & Rooney PC

(57) ABSTRACT

A vehicle door opening/closing device having a latch mechanism, a locking mechanism, an actuator, and a canceling mechanism is provided. The actuator has an electric motor and a pivotable drive lever. The canceling mechanism operates to block transmission of power between the electric motor and the drive lever when manipulation force of a vehicle door handle is transmitted to the canceling mechanism through the locking mechanism. The manipulation force of the door handle is transmitted to the canceling mechanism only when the vehicle door is in an unlocked state.

8 Claims, 13 Drawing Sheets

FOREIGN PATENT DOCUMENTS

| | | | |
|---|---|---|---|
| EP | 1 452 361 | A2 | 9/2004 |
| GB | 2 360 325 | A | 9/2001 |
| JP | 6-42247 | A | 2/1994 |
| JP | 9-112105 | A | 4/1997 |
| JP | 10-148051 | A | 6/1998 |
| JP | 2002-339623 | A | 11/2002 |
| JP | 2007-138534 | A | 6/2007 |

* cited by examiner

| | Locked | Unlocked |
|---|---|---|
| Canceling Operation | △ | ○ |
| Closer Operation | ○ | ○ |
| Releasing Operation | ○ | × |

OPENING/CLOSING DEVICE FOR VEHICLE DOOR

FIELD OF THE INVENTION

The present invention relates to a vehicle door opening/closing device.

BACKGROUND OF THE INVENTION

As a conventional vehicle door opening/closing device, a device described in Patent Document 1, for example, has been known. In the door opening/closing device of Patent Document 1, when the drive force produced by a drive unit is transmitted to a latch mechanism, the latch mechanism is switched from a half-latched state to a fully latched state so as to operate the vehicle door to close (closer operation). Specifically, by activating an electric motor in such a manner as to pivot a drive lever in one direction, a drive wire is pulled so as to transmit the drive force of the drive unit to the latch mechanism.

Also, in the door opening/closing device described in Patent Document 1, when the closer operation is performed and manipulation force of a door handle is transmitted to an open lever, the open lever is pivoted through a cancel cable connected to the open lever. This blocks transmission of the power between the electric motor and the drive lever (canceling operation). In this manner, by canceling the closer operation through manipulation of the door handle, the vehicle door opening/closing device prevents the vehicle door, for example, from catching an object.

Another vehicle door opening/closing device, which opens a vehicle door by switching a latch mechanism from a fully latched state to an unlatched state when drive force of a drive unit is transmitted to the latch mechanism (releasing operation), separately from the above-described closer operation, is also known.

If drive unit such as electric motors are provided separately for the closer operation and the releasing operation, the door opening/closing device as a whole enlarges in size and the number of the components increases. This raises the costs necessary for manufacturing the vehicle door opening/closing device. To solve this problem, in the drive unit of Patent Document 1, the applicant of the present application has proposed to drive the electric motor, when the vehicle door is to be opened, in such a manner as to pivot the drive lever in the direction opposite to the direction in which the drive lever is pivoted in the closer operation.

However, if the above-described configuration is employed in a vehicle with a door that is selectively locked and unlocked through manipulation of, for example, a portable device (an electronic key) carried by a user, the following problem occurs. Specifically, when the vehicle door is to be switched to an unlocked state by manipulating the portable device (the electronic key) after the door has been held locked by a locking mechanism, the door handle may be manipulated before the door is switched to the unlocked state. This brings about a "panic state", thus effectuating the aforementioned canceling operation. That is, the power transmission between the electric motor and the drive lever is blocked and thus the releasing operation cannot be performed. Patent Document 1: Japanese Laid-Open Patent Publication No. 2007-138534

SUMMARY OF THE INVENTION

Accordingly, it is an objective of the present invention to provide a vehicle door opening/closing device that performs both of a closer operation and a releasing operation using a single drive unit and ensures canceling operation without hampering the releasing operation even in a panic state.

To achieve the foregoing objective and in accordance with one aspect of the present invention, a vehicle door opening/closing device including a latch mechanism, a locking mechanism, a drive unit, and a cancelling mechanism is provided. The latch mechanism is switchable among a fully latched state, in which the latch mechanism holds a vehicle door in a fully closed state, a half-latched state, in which the latch mechanism holds the vehicle door in an ajar state, and an unlatched state, in which the latch mechanism does not hold the vehicle door. The locking mechanism is capable of switching the vehicle door between a locked state and an unlocked state. The drive unit has a drive source and a pivotable drive lever. The drive source transmits a drive force to the latch mechanism by pivoting the drive lever in a first direction from a predetermined initial position serving as a starting point, thereby switching the latch mechanism from the half-latched state to the fully latched state. The drive source transmits the drive force to the latch mechanism by pivoting the drive lever in a second direction opposite to the first direction from the predetermined initial position serving as the starting point, thereby switching the latch mechanism from the fully latched state or the half-latched state to the unlatched state. The canceling mechanism operates to block transmission of power between the drive source and the drive lever when a manipulation force of a vehicle door handle is transmitted to the canceling mechanism through the locking mechanism. The manipulation force of the door handle is transmitted to the canceling mechanism only when the vehicle door is in the unlocked state.

In this configuration, the latch mechanism is switched from the half-latched state to the fully latched state by pivoting the drive lever in the first direction from the predetermined initial position serving as the starting point by the drive source of the drive unit (closer operation). In contrast, the latch mechanism is switched from the fully latched state or the half-latched state to the unlatched state by pivoting the drive lever in the second direction opposite to the first direction from the predetermined initial position serving as the starting point (releasing operation). In these manners, the closer operation and the releasing operation are both carried out by the single drive unit, without providing an additional drive unit (an additional drive source and an additional drive lever). In other words, the single drive unit performs both of the closer operation and the releasing operation. Further, when the vehicle door is held in the unlocked state by the locking mechanism, the manipulation force of the door handle is transmitted to the canceling mechanism through the locking mechanism, thus blocking the power transmission between the drive source and the drive lever (canceling operation). As a result, the vehicle door is prevented from catching an object by canceling the closer operation by manipulating the door handle. Also, when the vehicle door is held in the locked state by the locking mechanism and the door handle is manipulated before the vehicle door is switched to the unlocked state (a panic state), the manipulation force of the door handle is prevented from being transmitted to the canceling mechanism through the locking mechanism unless the vehicle door is completely switched to the unlocked state. Accordingly, since the power transmission between the drive source and the drive lever of the drive unit is prevented from being blocked, the releasing operation, for example, is performed continuously regardless of manipulation of the door handle.

The vehicle door opening/closing device preferably further includes a releasing lever that is pivoted by the drive lever pivoting in the second direction to be engaged with the latch mechanism, thereby switching the latch mechanism from the fully latched state or the half-latched state to the unlatched state. The canceling mechanism includes a canceling lever that is arranged coaxially with the releasing lever and permitted to pivot relative to the releasing lever. The canceling lever has a pressing portion. The pressing portion is engageable with the locking mechanism and the releasing lever when the vehicle door is in the unlocked state. When the vehicle door is in the unlocked state, the manipulation force of the door handle is transmitted to the pressing portion through the locking mechanism in such a manner as to pivot the canceling lever, thereby causing the canceling lever to block the transmission of power between the drive source and the drive lever and causing the pressing portion to press the releasing lever to pivot the releasing lever.

In this configuration, since the canceling lever of the canceling mechanism is arranged coaxially with the releasing lever used in the releasing operation, the space for installing the canceling lever is reduced. Also, by causing the pressing portion to press the releasing lever so as to pivot the releasing lever when the canceling operation is performed, the canceling lever switches the latch mechanism from, for example, the fully latched state or the half-latched state to the unlatched state. Further, since the canceling lever is permitted to pivot relative to the releasing lever, the canceling lever permits the releasing lever to pivot independently without following the releasing lever, and thus does not hamper the releasing operation.

Preferably, when the vehicle door is in the locked state, the pressing portion cannot be engaged with the locking mechanism. When the vehicle door is in the locked state, the manipulation force of the door handle is not transmitted to the pressing portion through the locking mechanism so that the canceling lever does not pivot.

In this configuration, the pressing portion of the canceling lever cannot be engaged with the locking mechanism when the vehicle door is in the locked state. This prevents transmission of the manipulation force of the door handle to the pressing portion through the locking mechanism. The canceling lever thus does not pivot. Accordingly, if the door handle is manipulated, for example, when the vehicle door is being switched from the locked state to the unlocked state through activation of the drive source used in switching of the locking mechanism, the power transmission between the drive source and the drive lever is prevented from being blocked by the above-described operation of the canceling lever. The releasing operation is thus carried out continuously regardless of manipulation of the door handle.

The vehicle door opening/closing device preferably further includes a cam lever having a cam portion. When the drive lever pivots in the second direction from the predetermined initial position serving as the starting point, the drive lever becomes engaged with the cam portion in such a manner as to pivot the cam lever, thereby switching the latch mechanism from the fully latched state or the half-latched state to the unlatched state.

In this configuration, pivot of the drive lever in the second direction from the predetermined initial position serving as the starting point is transmitted to the latch mechanism through the cam lever, which is engaged with the drive lever through the cam portion. The latch mechanism is thus switched from the fully latched state or the half-latched state to the unlatched state. Accordingly, even if the initial position, which is the starting point, of the drive lever is varied, such variation is effectively absorbed by setting a dead zone between the drive lever and the engaged cam portion until the latch mechanism starts to operate.

Preferably, when the drive lever pivots in the second direction from the predetermined initial position serving as the starting point, the drive lever becomes engaged with the cam portion in such a manner as to pivot the cam lever in the same direction as the first direction.

In this configuration, the pivotal direction of the cam lever used in the releasing operation is the same as the pivotal direction of the drive lever used in the closer operation. Accordingly, in both of the releasing operation and the closer operation, the latch mechanism is operated by a similar configuration using pivot of the cam lever and the drive lever in the same directions.

The vehicle door opening/closing device preferably further includes a sun gear, a ring gear, a planetary gear, and a carrier. The sun gear is driven by the drive source to rotate. The ring gear has an engagement portion formed in an outer circumferential surface thereof and is arranged coaxially with the sun gear. The planetary gear is engaged with the sun gear and the ring hear, and rotates relative to and revolves about the ring gear when the sun gear rotates. The carrier is arranged coaxially with the sun gear and connected to the planetary gear. The carrier rotates integrally with the drive lever as the planetary gear rotates and revolves. The canceling mechanism has an engagement/disengagement member. The engagement/disengagement member becomes engaged with the engagement portion in such a manner that the ring gear cannot rotate. The engagement/disengagement member becomes disengaged from the engagement portion so as to permit the ring gear to rotate when the manipulation force of the door handle is transmitted to the engagement/disengagement member through the locking mechanism.

Preferably, the canceling lever of the canceling mechanism is arranged coaxially with the releasing lever used in the releasing operation. This reduces the space for installing the canceling lever. Further, by pressing the releasing lever by means of the pressing portion to pivot the releasing lever when the canceling operation is performed, the canceling lever switches the latch mechanism from, for example, the fully latched state or the half-latched state to the unlatched state. Further, since the canceling lever is permitted to pivot relative to the releasing lever, the canceling lever allows the releasing lever to pivot independently without following the releasing lever. The canceling lever thus does not hamper the releasing operation.

DETAILED DESCRIPTION OF THE PREFERRED EMBODIMENTS

An embodiment of the present invention will now be described with reference to the attached drawings.

Figure 1:
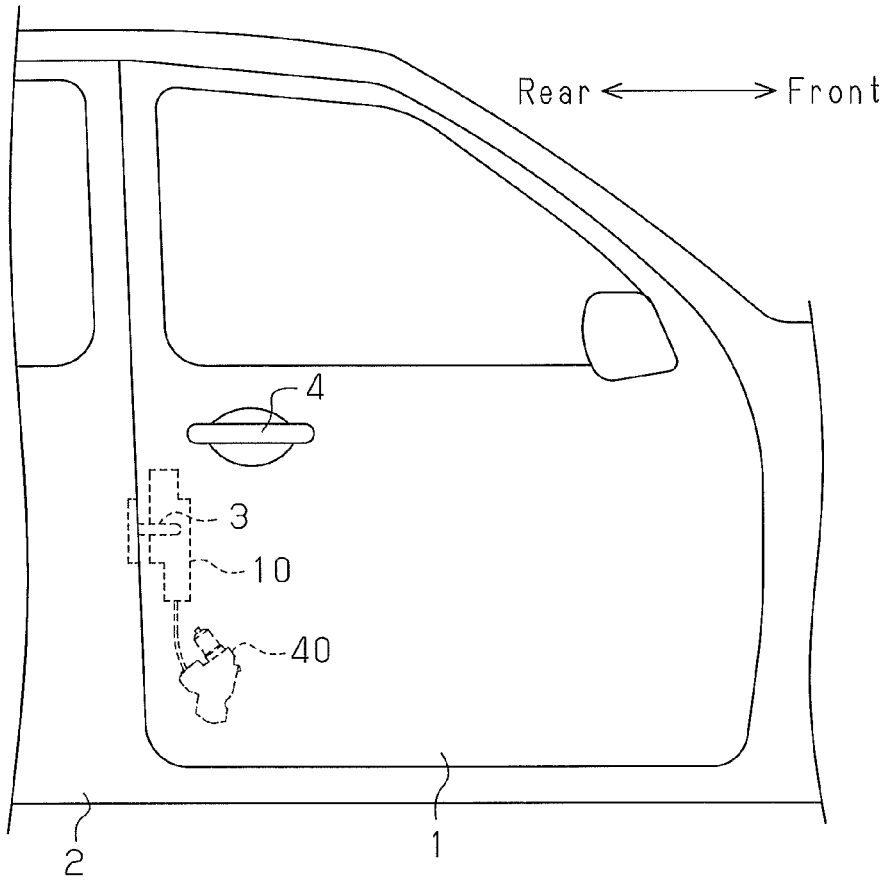
FIG. 1 is a front view showing a vehicle door according to an embodiment of the present invention.
Figure 2:
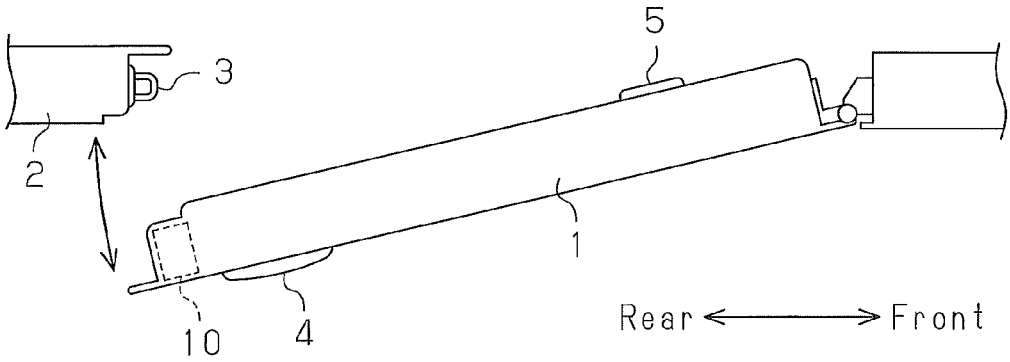
FIG. 2 is a plan view showing the vehicle door illustrated in FIG. 1.

FIG. 1 is a front view showing a vehicle door 1 according to one embodiment of the present invention, and FIG. 2 is a plan view showing the vehicle door 1 illustrated in FIG. 1. As shown in FIGS. 1 and 2, the vehicle door 1 is a swing door that is hinged to a body frame 2 in such a manner as to selectively open and close an opening of the passenger compartment of the vehicle. A door latch device 10 is mounted in a rear end portion of the vehicle door 1. The door latch device 10 is engaged with a substantially U-shaped striker 3 fixed to the body frame 2 and maintains the vehicle door 1 ajar or fully closed. The door latch device 10 is connected to an outside door handle 4 mounted in an outer wall of the vehicle door 1 and an inside door handle 5 arranged in an inner wall of the vehicle door 1. When manipulation force acting on either one of the door handles 4, 5 is transmitted to the door latch device 10, the door latch device 10 is disengaged from the striker 3 in order to open the vehicle door 1.

The door latch device 10 is connected to an actuator 40 serving as a drive unit mounted in the vehicle door 1. When the drive force acting in a first direction is transmitted from the actuator 40 to the door latch device 10, the door latch device 10 becomes engaged with the striker 3 so as to operate the vehicle door 1 to close from the ajar state to the fully closed state. Contrastingly, when the drive force acting in a second direction opposite to the first direction is transmitted from the actuator 40 to the door latch device 10, the door latch device 10 becomes disengaged from the striker 3 so as to open the vehicle door 1 from the fully closed state or the ajar state. The actuator 40 is connected to both of the door handles 4, 5. When the manipulation force applied to either one of the door handles 4, 5 is transmitted to the actuator 40, the actuator 40 blocks transmission of the drive force to the door latch device 10.

The configuration of the door latch device 10 will hereafter be explained with reference to FIGS. 3 to 9.

Figure 3:
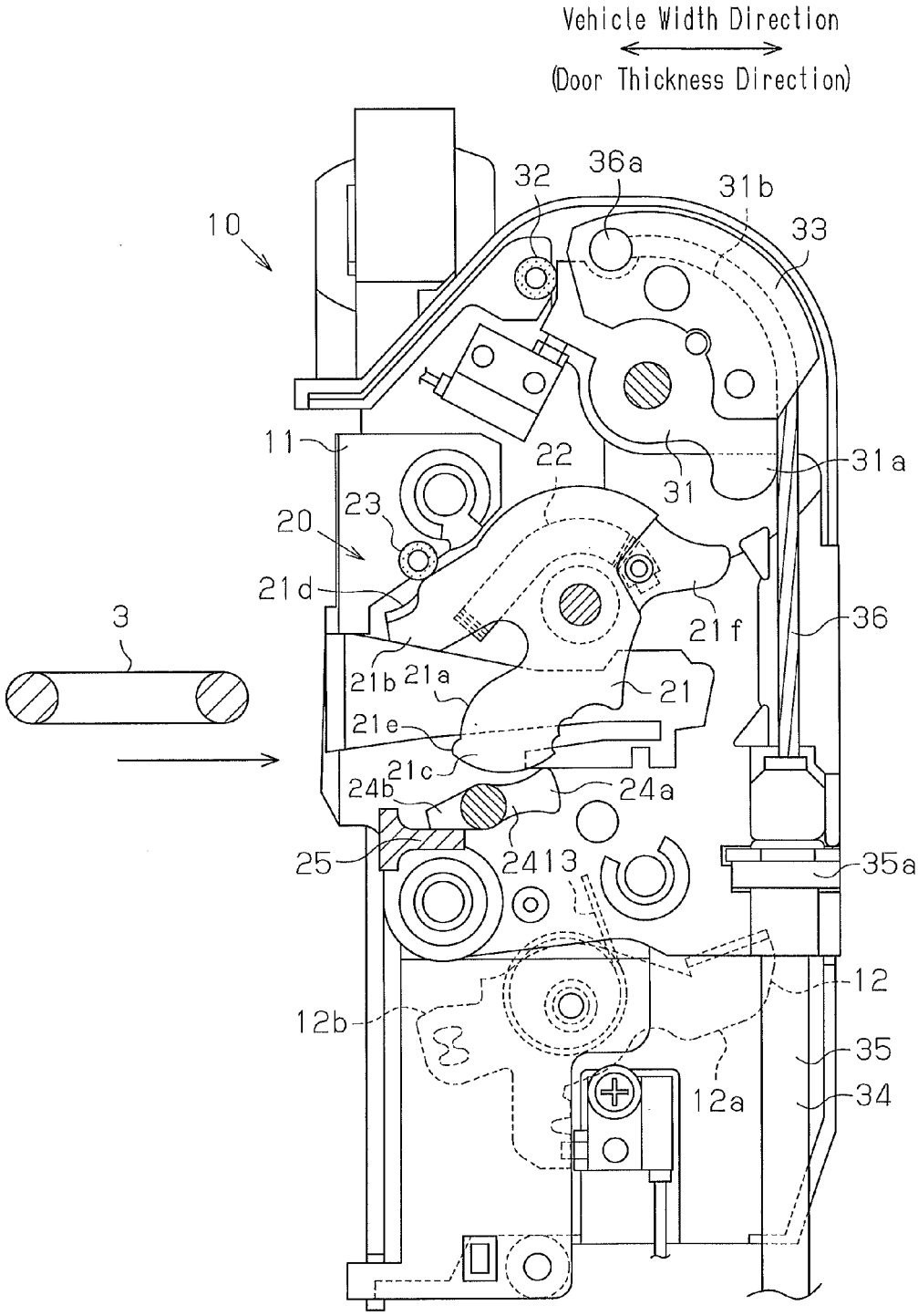
FIG. 3 is a front view illustrating an unlatched state of a door latch device mounted in the vehicle door of FIG. 1.
Figure 4:
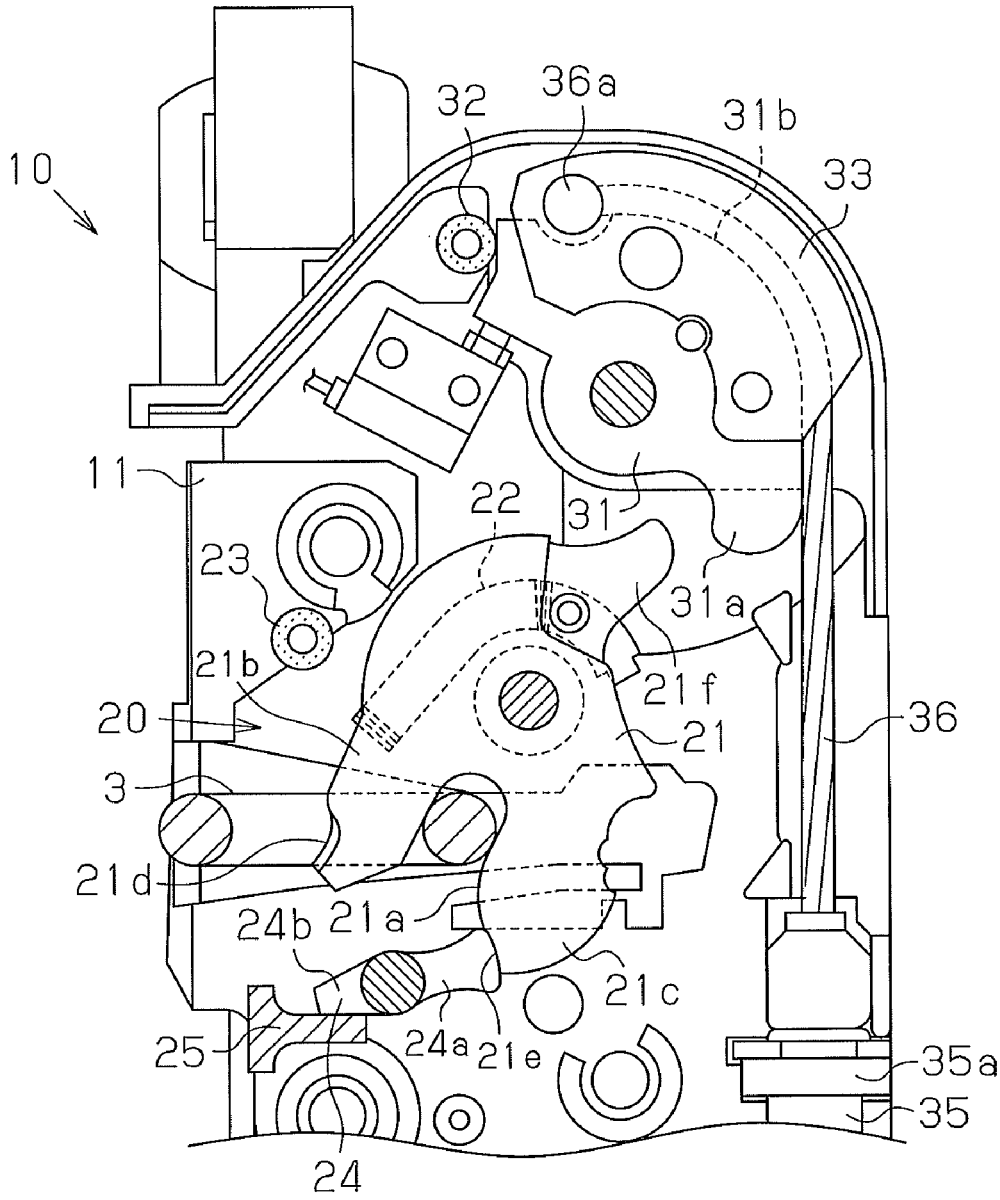
FIG. 4 is a front view illustrating a half-latched state of the door latch device illustrated in FIG. 3.
Figure 5:
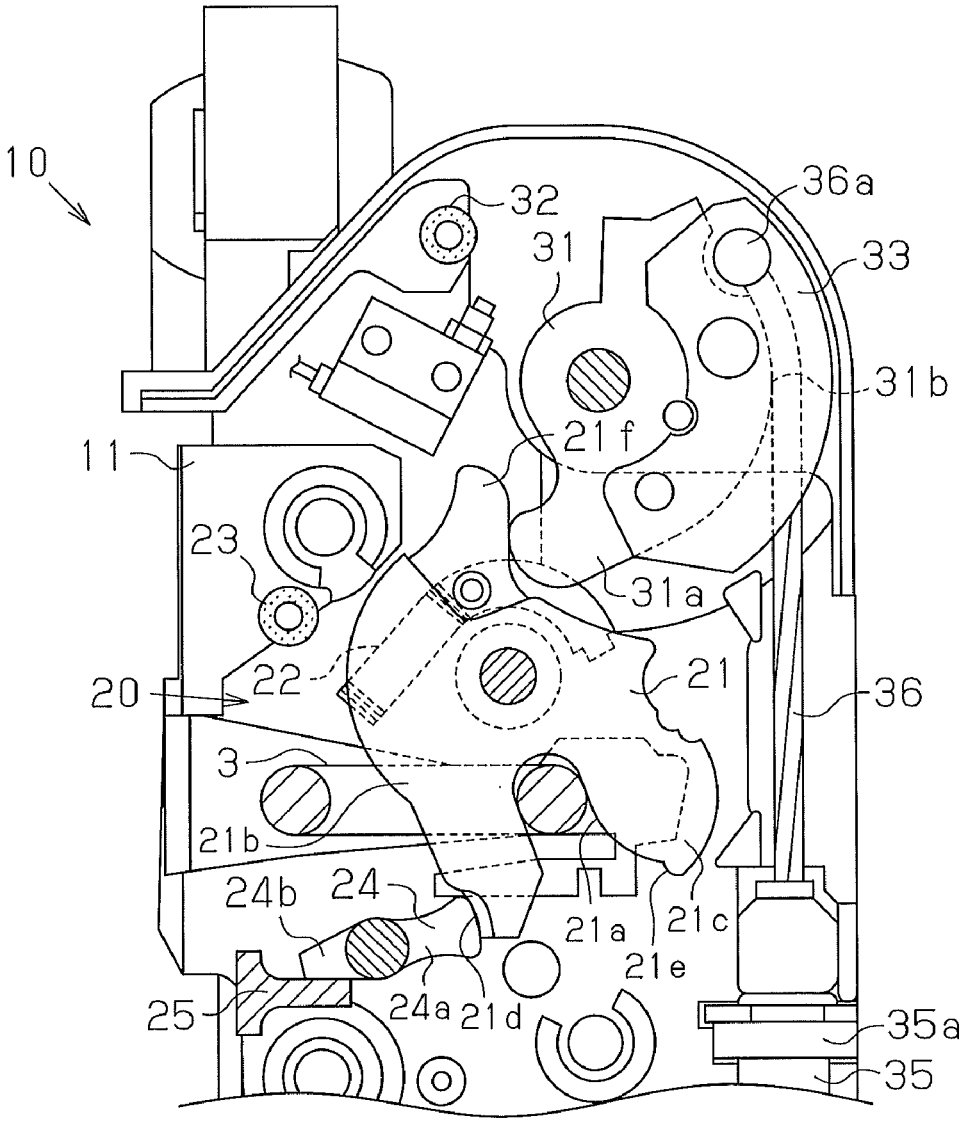
FIG. 5 is a front view illustrating a fully latched state of the door latch device of FIG. 3.
Figure 6:
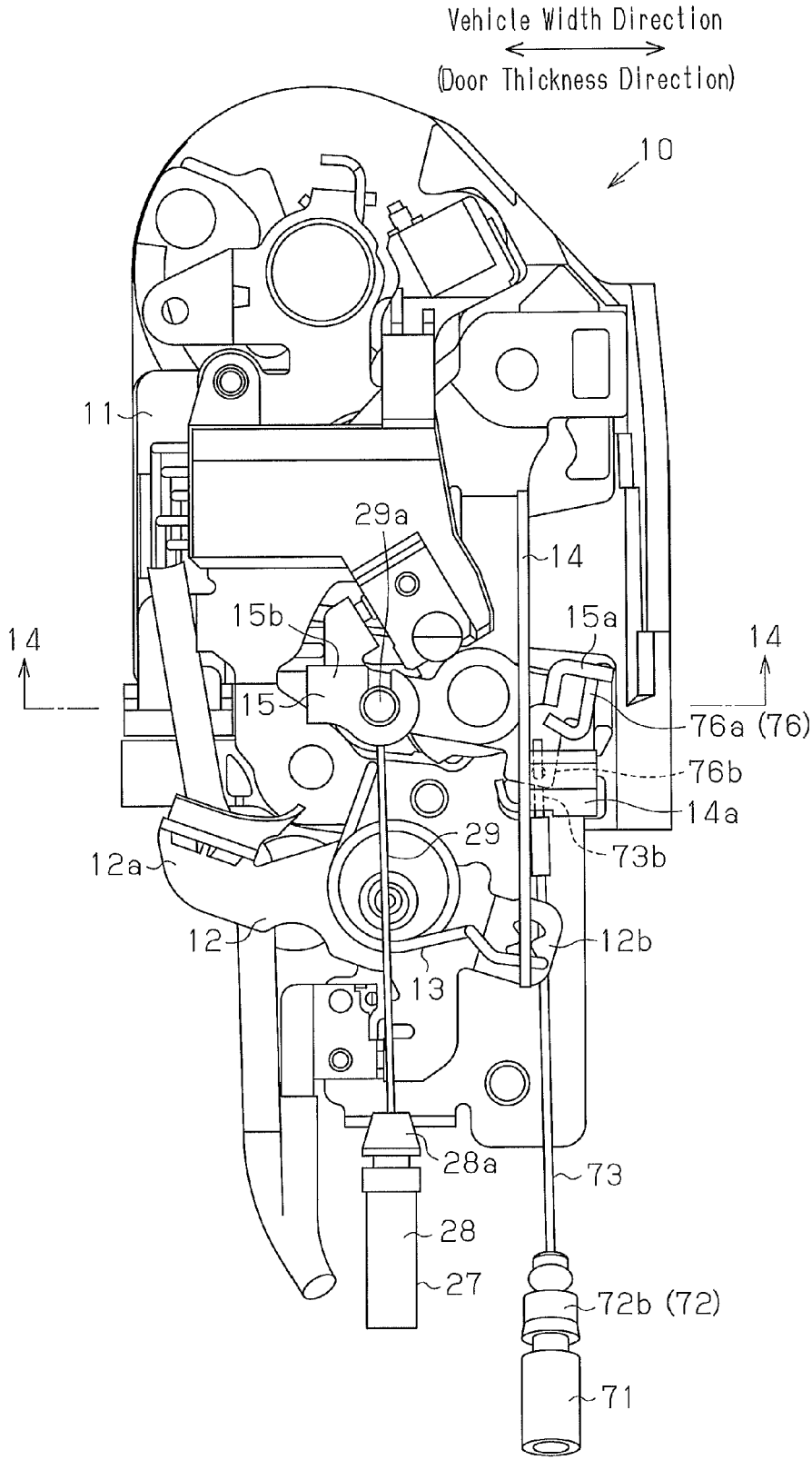
FIG. 6 is a rear view showing the door latch device of FIG. 3.
Figure 7:
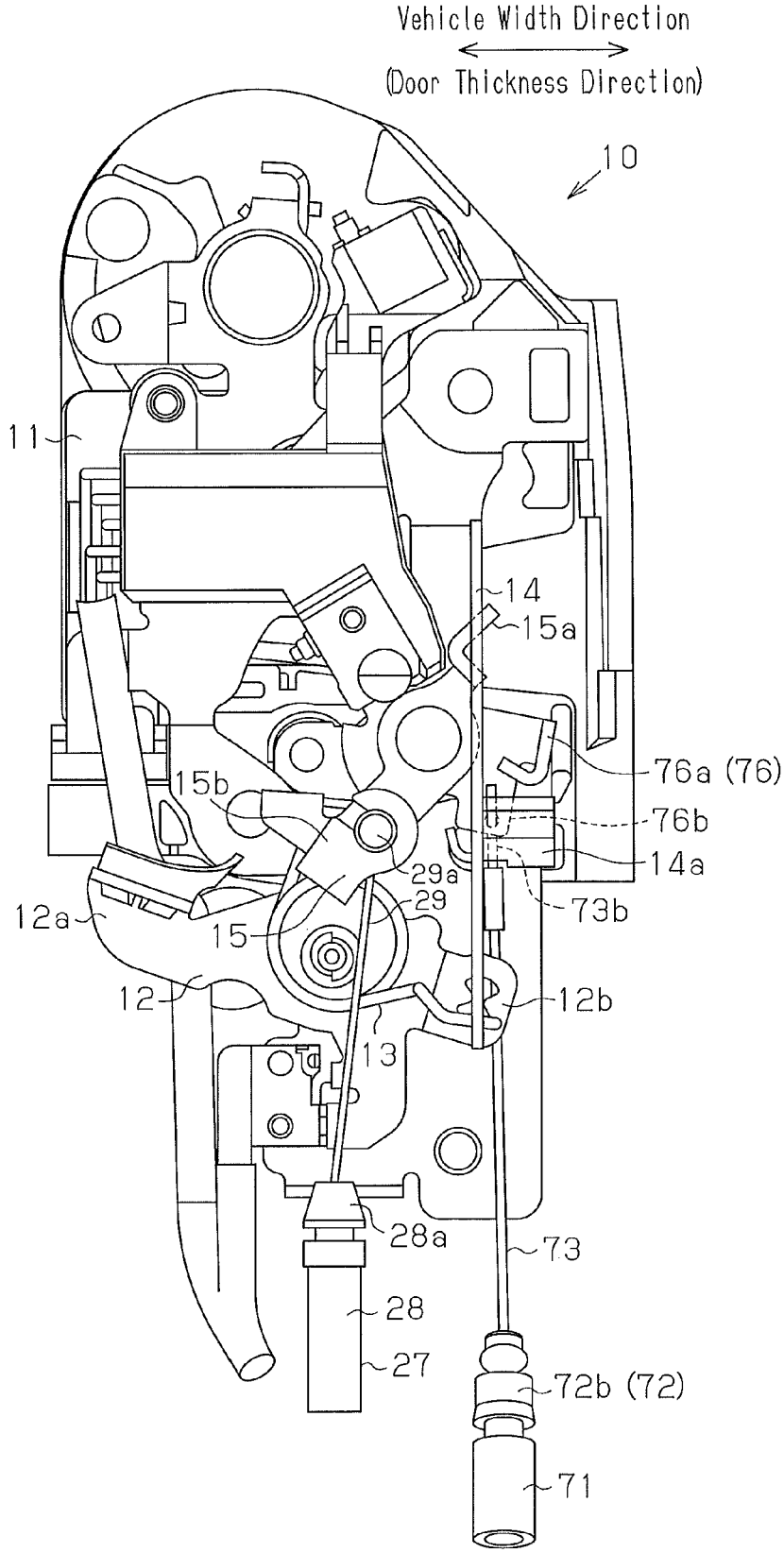
FIG. 7 is a rear view illustrating operation of the door latch device shown in FIG. 6.
Figure 8:
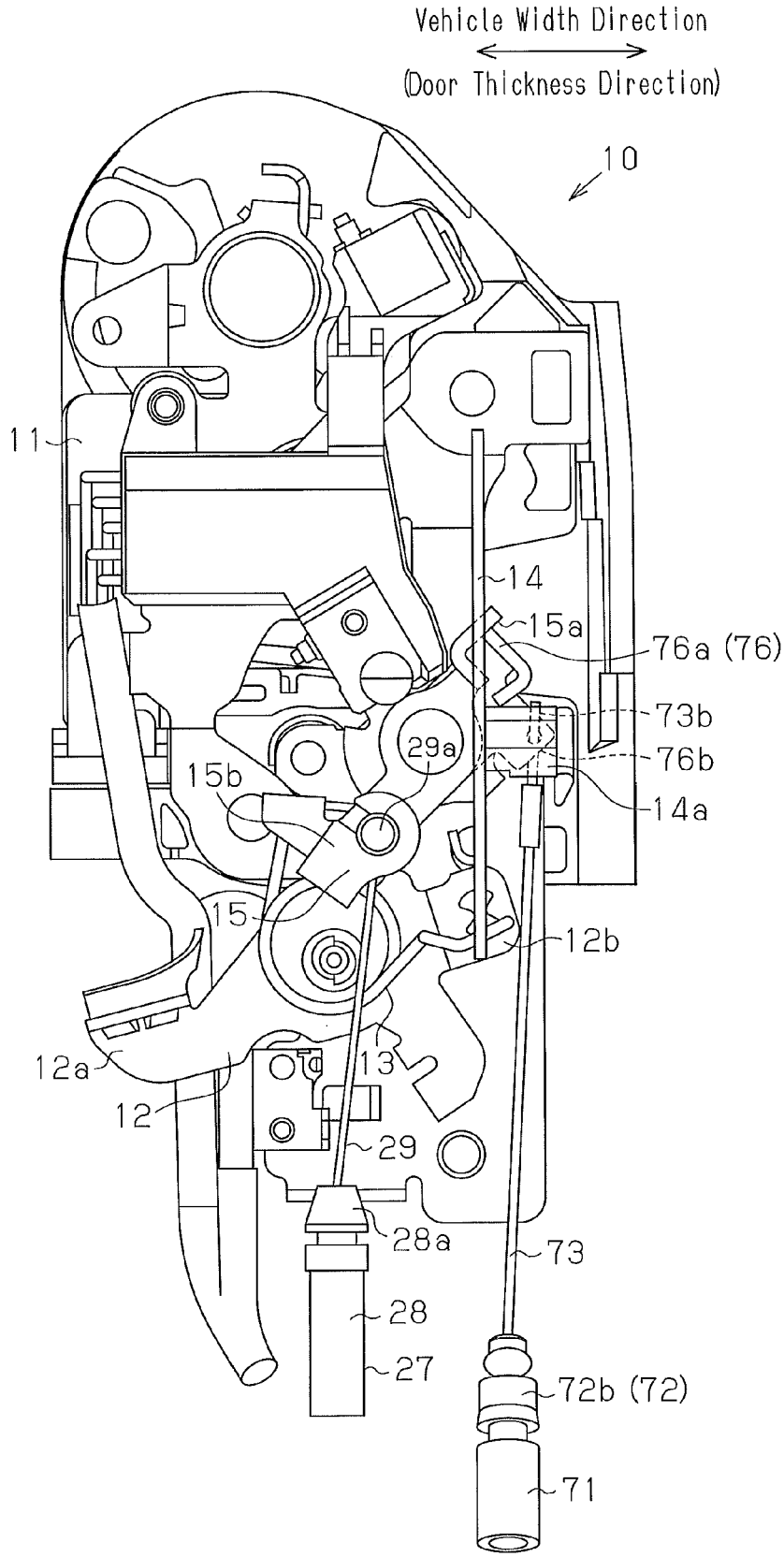
FIG. 8 is a rear view illustrating operation of the door latch device shown in FIG. 6.
Figure 9:
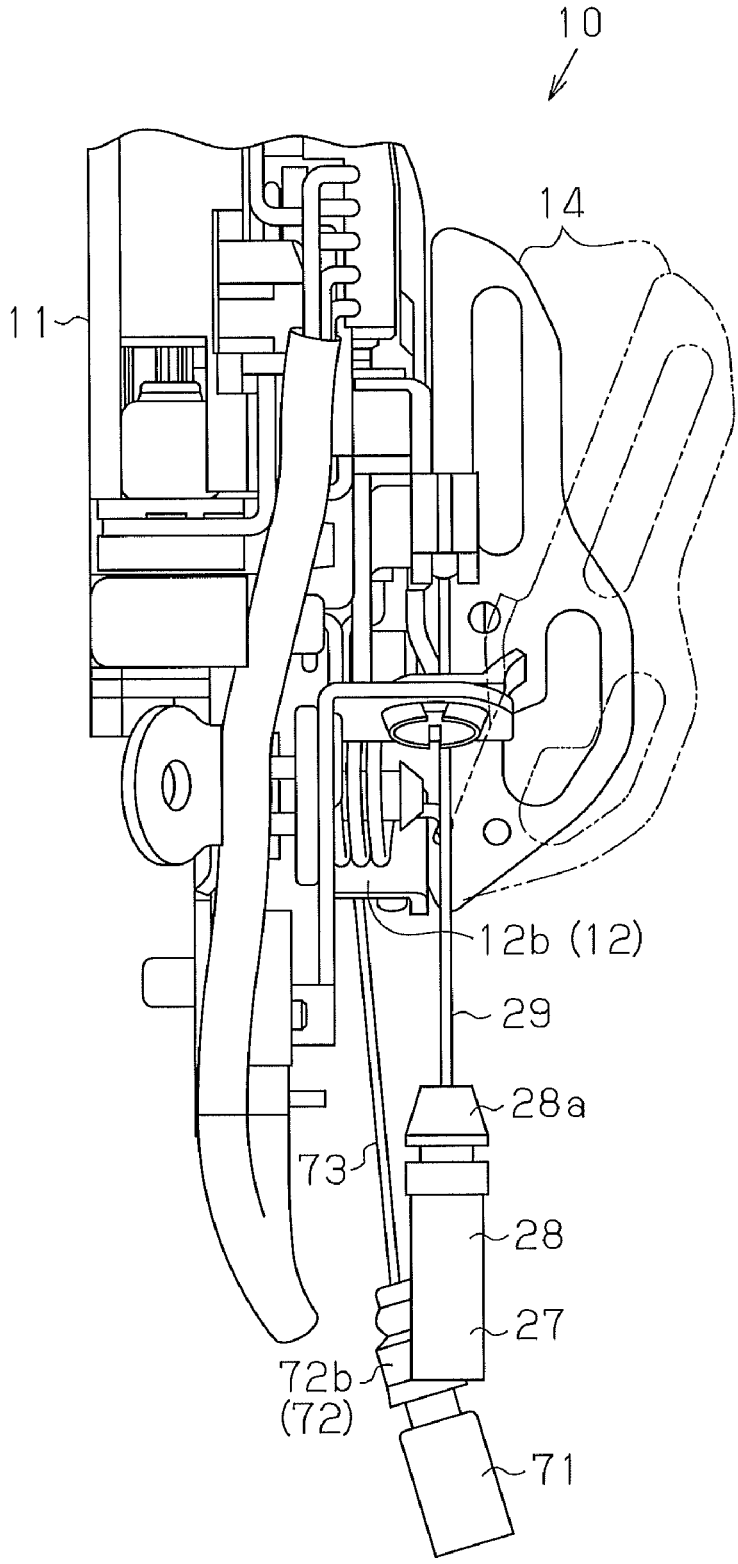
FIG. 9 is a side view showing the door latch device illustrated in FIG. 3.

FIGS. 3 to 5 are front views each showing the door latch device 10 and correspond to elevated views illustrating the door latch device 10 as viewed from the rear side of the vehicle. FIGS. 6 to 8 are rear views each showing the door latch device 10 and correspond to elevated views illustrating the door latch device 10 as viewed from the front side of the vehicle. FIG. 9 is a side view showing the door latch device 10 and corresponds to an elevated view illustrating the door latch device 10 as viewed from an outer side in the direction of the width of the vehicle.

As shown in FIGS. 3 to 5, the door latch device 10 has a body portion 11 that forms the outline of the door latch device 10 and accommodates and supports various types of components of the door latch device 10. The body portion 11 pivotally supports an open lever 12 formed by a plate. The open lever 12 is urged by a torsion spring 13 in such a manner that the open lever 12 is maintained at a predetermined pivotal position. A first end 12*a* (the right end as viewed in FIG. 3) of the open lever 12 is connected to the outside door handle 4 with a known connection member. When the manipulation force acting on the outside door handle 4 is transmitted to the first end 12*a*, the open lever 12 is pivoted in a clockwise direction in FIG. 3 against the torsion spring 13, thus raising a second end 12*b* (the left end as viewed in FIG. 3) of the open lever 12. When the open lever 12 is released from the manipulation force of the outside door handle 4, the open lever 12 is urged by the torsion spring 13 and pivoted in a counterclockwise direction in FIG. 3, thus lowering the second end 12*b*. In this manner, the open lever 12 is returned to the aforementioned predetermined pivotal position.

With reference to FIGS. 6 and 9, the second end 12*b* of the open lever 12 is connected to a lower end of an open link 14, which is formed by a plate, in a swingable manner. The open link 14 is mounted in a locking mechanism, and an L-shaped flange 14*a* is formed in a central portion of the open link 14 in the up-down direction. A canceling lever 76, which is formed by a plate, is pivotally supported by the body portion 11 at a position above the open lever 12. The canceling lever 76 has a canceling pressing portion 76*a* serving as a plate-like pressing portion, which is arranged above the flange 14*a*. The canceling pressing portion 76*a* is bent forward in a direction perpendicular to the sheet surface of FIG. 6 with respect to the canceling lever 76. When the open link 14 is at an unlocked position (represented by the solid lines in FIG. 9), the flange 14*a* is located at a position below the canceling pressing portion 76*a* of the canceling lever 76 and faces the canceling pressing portion 76*a*, as illustrated in FIG. 6. Accordingly, if the open link 14 is raised in this state, the flange 14*a* presses the canceling pressing portion 76*a* to pivot the canceling lever 76 in a counterclockwise direction in FIG. 6. When the open link 14 is at a locked position (represented by the double-dotted chain lines in FIG. 9), the flange 14*a* is located at a position below the canceling pressing portion 76*a* of the canceling lever 76 but does not face the canceling pressing portion 76*a*. Accordingly, even if the open link 14 is raised in this state, the flange 14*a* is prevented from pressing the canceling pressing portion 76*a*. The canceling lever 76 has an attachment piece 76*b* extending downward with respect to the canceling pressing portion 76*a*. The canceling lever 76 raises the attachment piece 76*b* by pivoting in the counterclockwise direction in FIG. 6 about the pivot axis of the canceling lever 76.

The open link 14 moves upward when, for example, the second end 12*b* rises as the open lever 12 pivots. Further, an inside open lever (not shown), to which the manipulation force of the inside door handle 5 is transmitted, is pivotally supported by the body portion 11. The open link 14 moves upward also when the inside open lever pivots and thus presses the flange 14*a*.

The open link 14 is switched between the unlocked position and the locked position by, for example, activating an actuator formed in the locking mechanism through communication between a portable device (an electronic key) carried by a user and the vehicle or by manipulating a key cylinder formed in the outside door handle 4 or by depressing a lock button arranged in the side of the vehicle door 1 facing the interior of the passenger compartment.

Figures 14, 15:
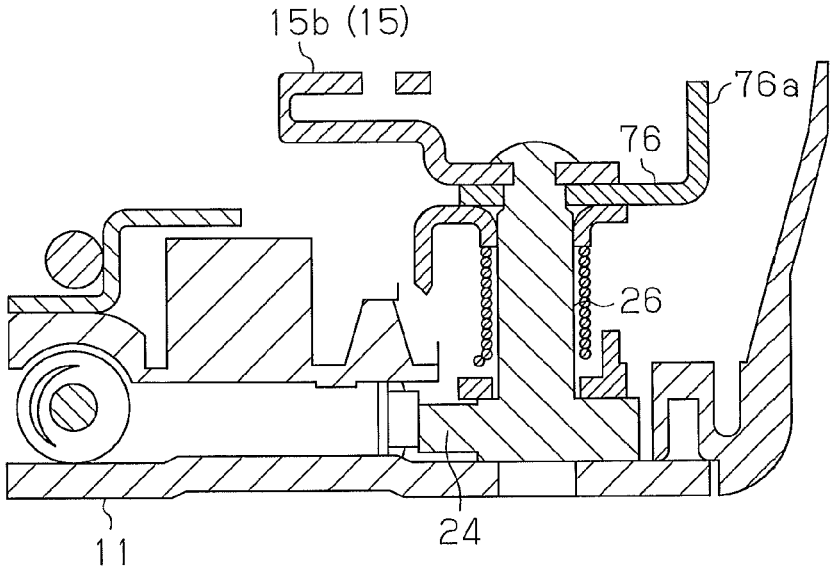
FIG. 14 is a cross-sectional view taken along line 14-14 of FIG. 6.
FIG. 15 is a table representing the relationship between the state of the vehicle door and the operation of the door latch device.

Also, a lift lever 15, which is arranged coaxially with the canceling lever 76 and formed by a plate, is pivotally supported by the body portion 11. The lift lever 15 serving as a releasing lever has a plate-like engagement piece 15*a*, which is arranged at a position above the canceling pressing portion 76*a* and on the pivotal path of the canceling pressing portion 76*a*. The engagement piece 15*a* is bent forward in a direction perpendicular to the sheet surface of FIG. 6 with respect to the lift lever 15. FIG. 14 is a cross-sectional view taken along line 14-14 of FIG. 6. As illustrated in FIG. 14, the lift lever 15 is arranged adjacent to one side (the upper side as viewed in the drawing) of the canceling lever 76 in the axial direction to be pivotable relative to the canceling lever 76. When the canceling lever 76 pivots in the counterclockwise direction in FIG. 6, the canceling pressing portion 76*a* is pressed by the engagement piece 15*a* of the lift lever 15. This pivots the lift lever 15 and the canceling lever 76 integrally with each other in the counterclockwise direction in FIG. 6. When the canceling lever 76 pivots in a clockwise direction in FIG. 6, the lift lever 15 is stopped and maintained at the predetermined pivotal position illustrated in FIG. 6.

As illustrated in FIG. 3, a latch 21 is pivotally supported by the body portion 11 at a position above the open lever 12. The latch 21 is formed substantially in a U shape and has an engagement recess 21*a*. The latch 21 includes a first claw portion 21*b* and a second claw portion 21*c*, which are arranged at opposite sides of the engagement recess 21*a*. The first claw portion 21*b* is formed at the left side as viewed in FIG. 3 with respect to the engagement recess 21*a*, and the second claw portion 21*c* is formed at the right side as viewed in FIG. 3 with respect to the engagement recess 21*a*. A first engagement portion 21*d* is formed in a portion opposite to the engagement recess 21*a* in a distal portion of the first claw portion 21*b*. A second engagement portion 21*e* is formed in a portion facing the engagement recess 21*a* in a distal portion of the second claw portion 21*c*. The latch 21 also has a follower projection 21*f*, which extends outward in a radial direction of the pivot axis of the latch 21 at the side opposite to the engagement recess 21*a* with respect to the pivot axis of the latch 21. An end of a latch urging spring 22, the other end of which is hooked to the body portion 11, is hooked to the latch 21. The latch urging spring 22 urges the latch 21 in a clockwise direction in FIG. 3. When a latch stopper 23 arranged in the body portion 11 contacts the facing surface of the first claw portion 21*b*, pivot of the latch 21 in the clockwise direction in FIG. 3 is restricted and the latch 21 is maintained at the predetermined pivotal position.

A pole 24 is pivotally supported by the body portion 11 at a position between the open lever 12 and the latch 21. With reference to FIG. 14, the pole 24 is connected to the lift lever 15 in such a manner as to pivot integrally with the lift lever 15. As illustrated in FIG. 3, the pole 24 has an engagement end 24*a* and an extended end 24*b*, which extend to both sides of a radial direction of the pivot axis of the pole 24. The engagement end 24*a* extends rightward and the extended end 24*b* extends leftward with respect to the pivot axis of the pole 24. An end of a pole urging spring 26 (see FIG. 14), the other end of which is hooked to the body portion 11 at a predetermined position, is hooked to the pole 24. The pole urging spring 26 urges the pole 24 in such a manner as to pivot the pole 24 in a counterclockwise direction in FIG. 3, that is, to raise the engagement end 24*a*. When a pole stopper 25 arranged in the body portion 11 contacts a facing surface of the extended end 24*b*, pivot of the pole 24 in a counterclockwise direction in FIG. 3 is restricted and the pole 24 is maintained at a predetermined pivotal position, together with the lift lever 15. The pole 24 constitutes the latch mechanism 20 together with the latch 21 and the like.

The basic operation of the latch mechanism 20 will hereafter be explained. When the vehicle door 1 is in an open state, the latch 21 is maintained at the predetermined pivotal position through contact between the latch 21 stopper 23 and the facing surface of the first claw portion 21*b*, as illustrated in FIG. 3. When the latch 21 is located at this pivotal position, the striker 3 is permitted to enter the engagement recess 21*a* as the vehicle door 1 is operated to close. The pole 24 is maintained at the predetermined pivotal position by contact between the pole stopper 25 and the facing surface of the extended end 24*b*. The engagement end 24*a* is located below the second claw portion 21*c*. In this state, the state of the latch mechanism 20 is referred to as an unlatched state.

Then, when the striker 3 enters the engagement recess 21*a* as the vehicle door 1 is operated to close, the striker 3 presses an inner wall surface of the engagement recess 21*a* from the side corresponding to the inner wall of the vehicle door 1 to the side corresponding to the outer wall of the vehicle door 1. This pivots the latch 21 in a counterclockwise direction in FIG. 4 against the latch urging spring 22 as illustrated in FIG. 4, and the engagement end 24*a* becomes engaged with the second engagement portion 21*e*. In this state, the striker 3 is engaged with the engagement recess 21*a* and prevented from separating from the engagement recess 21*a*. The vehicle door 1 is thus maintained in the ajar state. The current state of the latch mechanism 20 is referred to as a half-latched state.

Subsequently, when the striker 3 further enters the engagement recess 21*a*, the striker 3 further presses the inner wall surface of the engagement recess 21*a* from the side corresponding to the inner wall of the vehicle door 1 to the side corresponding to the outer wall of the vehicle door 1. This pivots the latch 21 further in a counterclockwise direction in FIG. 5 against the latch urging spring 22 as illustrated in FIG. 5, and the engagement end 24*a* becomes engaged with the first engagement portion 21*d*. In this state, the striker 3 is engaged with the engagement recess 21*a* and prevented from separating from the engagement recess 21*a*. The vehicle door 1 is thus in a fully closed state. The current state of the latch mechanism 20 is referred to as a fully latched state.

When the latch mechanism 20 is in the aforementioned half-latched or fully latched state and the pole 24 is pivoted in the clockwise direction in FIGS. 4 and 5 against the pole urging spring 26, the engagement end 24*a* becomes disengaged from the first engagement portion 21*d* and the second engagement portion 21*e*. In this state, the latch 21 is urged by the latch urging spring 22 to pivot in the clockwise direction in FIGS. 4 and 5 in such a manner that the inner wall surface of the engagement recess 21*a* presses the striker 3 from the side corresponding to the outer wall of the vehicle door 1 to the side corresponding to the inner wall of the vehicle door 1. This disengages the vehicle door 1 from the striker 3 in the engagement recess 21*a*, thus switching the vehicle door 1 to an openable state.

Accordingly, when the latch mechanism 20 is in the half-latched state or the fully latched state and the open link 14 is at the unlocked position, the flange 14*a* is caused to press the canceling pressing portion 76*a* as illustrated in FIG. 8 by raising the open link 14 in the above-described manner through manipulation of the door handle 4, 5. This pivots the canceling lever 76 in the counterclockwise direction in FIG. 8, thus causing the canceling pressing portion 76*a* to press the engagement piece 15*a* so as to pivot the lift lever 15 in the counterclockwise direction in FIG. 8. In this manner, the pole 24 is pivoted in the clockwise direction in FIGS. 4 and 5 against the pole urging spring 26. This switches the vehicle door 1 to the openable state. The state of the locking mechanism at the time when the open link 14 is at the unlocked position is referred to as an unlocked state of the vehicle door 1.

When the latch mechanism 20 is in the fully latched state or the half-latched state and the open link 14 is at the locked position, the canceling lever 76 and the lift lever 15 are both prevented from pivoting even if the open link 14 is raised in the above-described manner through manipulation of the door handle 4, 5. Accordingly, the vehicle door 1 cannot be switched to the openable state. The state of the locking mechanism at the time when the open link 14 is at the locked position is referred to as a locked state of the vehicle door 1.

As illustrated in FIG. 6, the body portion 11 holds an end 28*a* of an outer tube 28 of a releasing cable 27 at a position below the open lever 12. In the lift lever 15, a distal end 15*b* extending to the opposite side to the engagement piece 15*a* holds an end 29*a* of a drive wire 29 extending out of the end 28*a*. Accordingly, when the drive wire 29 is retracted into the end 28*a* as illustrated in FIG. 7, the lift lever 15 is pivoted in a counterclockwise direction in FIG. 7. When the pole 24 is pivoted in the clockwise direction in FIGS. 4 and 5 against the pole urging spring 26, the vehicle door 1 is switched to the openable state in the above-described manner. The drive wire 29 (the releasing cable 27) is connected to the actuator 40. When the drive force of the actuator 40 acting in the first direction is transmitted to the drive wire 29 (the releasing cable 27), the drive wire 29 is retracted into the end 28*a*.

As illustrated in FIG. 3, an operating lever 31 is pivotally supported by the body portion 11 at a position above the latch 21. The operating lever 31 has a drive projection 31*a* extending in a predetermined direction (in a downward direction as viewed in FIG. 3). When an end of a lever urging spring (not shown), the other end of which is hooked to the body portion 11, is hooked to the operating lever 31, the operating lever 31 is urged to pivot in a counterclockwise direction in FIG. 3. When the operating lever 31 contacts a lever stopper 32 arranged in the body portion 11, pivot of the operating lever 31 in the counterclockwise direction in FIG. 3 is restricted and the operating lever 31 is maintained at a predetermined pivotal position. With reference to FIG. 4, when the latch mechanism 20 is in the half-latched state, the follower projection 21*f* of the latch 21 is arranged on the pivotal path of the drive projection 31*a*.

The operating lever 31 has an arcuate guide surface 31*b* at a position above the pivot axis of the operating lever 31. Two guide plates 33 (only one is shown in FIG. 3), each formed by a plate, are fixed to the operating lever 31 on the opposite sides of the guide surface 31*b*. An end 35*a* of an outer tube 35, which configures a closer cable 34, is held by the body portion 11 at a position below the operating lever 31. The guide plates 33 hold an end 36*a* of a drive wire 36, which extends out of the end 35*a* and is guided by the guide surface 31*b*. Accordingly, when the drive wire 36 is retracted into the end 35*a* of the outer tube 35, the operating lever 31, which is fixed to the guide plates 33, is pivoted in a clockwise direction in FIG. 3 against the lever urging spring. The drive wire 36 (the closer cable 34) is connected to the actuator 40. When the drive force of the actuator 40 acting in the first direction is transmitted to the drive wire 36, the drive wire 36 is retracted into the end 35*a* of the outer tube 35 in such a manner that the operating lever 31 is pivoted in the clockwise direction in FIG. 3.

When the latch mechanism 20 is in the half-latched state as illustrated in FIG. 4 and the drive wire 36 is retracted into the end 35*a* of the outer tube 35, the operating lever 31 is pivoted in a counterclockwise direction in FIG. 4. This causes the drive projection 31*a* to press the follower projection 21*f* of the latch 21. In this manner, the latch 21 is pivoted in a counterclockwise direction in FIG. 4 against the latch urging spring 22. The striker 3, which is engaged with the engagement recess 21*a*, is thus pulled in such a manner as to switch the latch mechanism 20 to the fully latched state. In this state, the vehicle door 1 is operated to close from the ajar state to the fully closed state.

Figure 10:
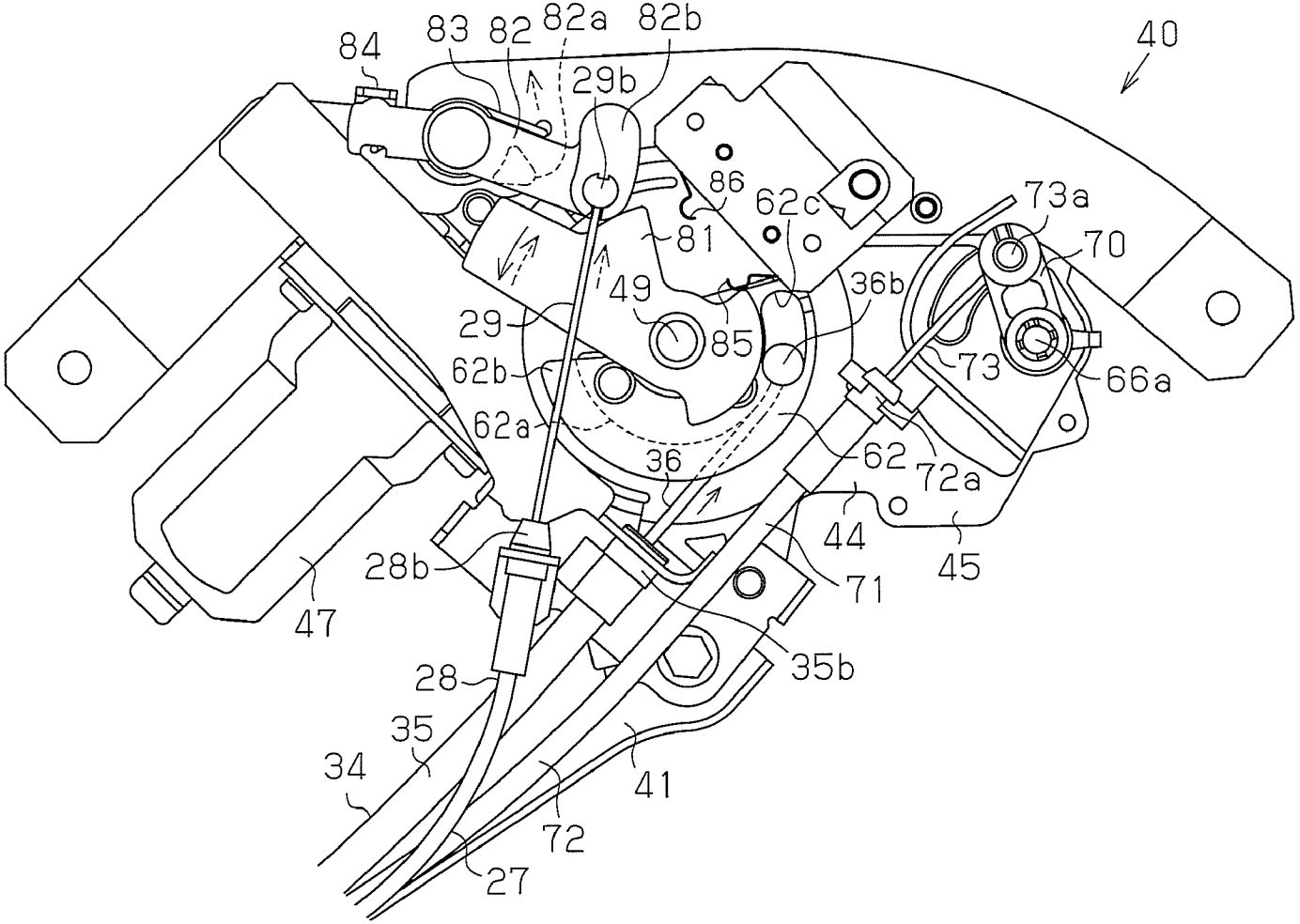
FIG. 10 is a front view showing an actuator connected to the door latch device illustrated in FIG. 1.
Figure 11:
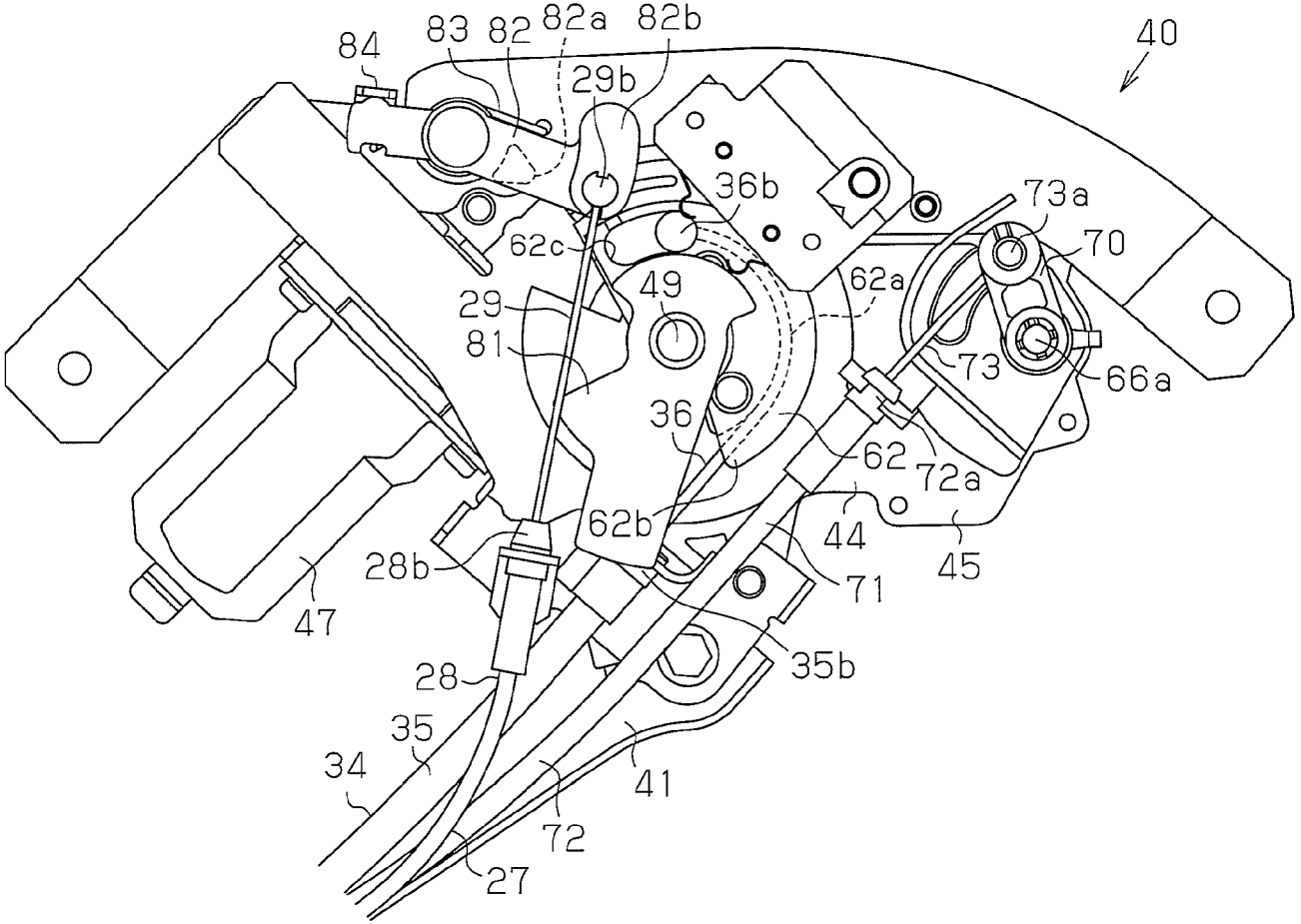
FIG. 11 is a front view illustrating operation of the actuator shown in FIG. 10.
Figure 12:
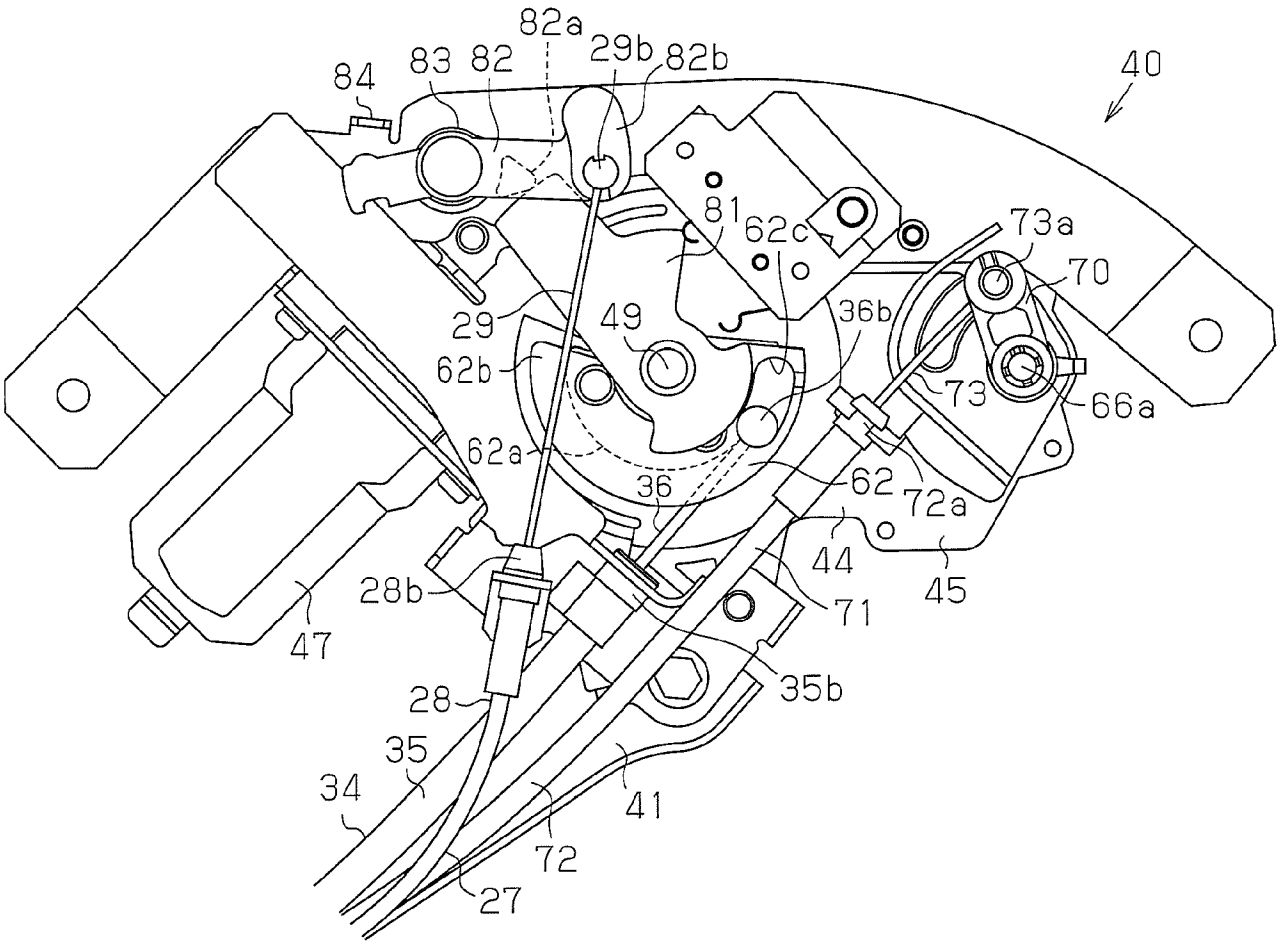
FIG. 12 is a front view illustrating operation of the actuator shown in FIG. 10.

The configuration of the actuator 40 will now be described with reference to FIGS. 10 to 13. FIGS. 10 to 12 are front views each showing the actuator 40 and correspond to elevated views of the actuator 40 as viewed from an outer side of the direction of the width of the vehicle. FIG. 14 is a rear view showing the actuator 40.

As illustrated in FIG. 10, the actuator 40 has a box-like housing 44 that forms the outline of the actuator 40 and accommodates and supports various components of the actuator 40. The housing 44 is fastened to a bracket 41 formed by a plate. The bracket 41 is fixed to and supported in the vehicle door 1. The bracket 41 is fastened and fixed to the body portion 11 of the door latch device 10.

Figure 13A:
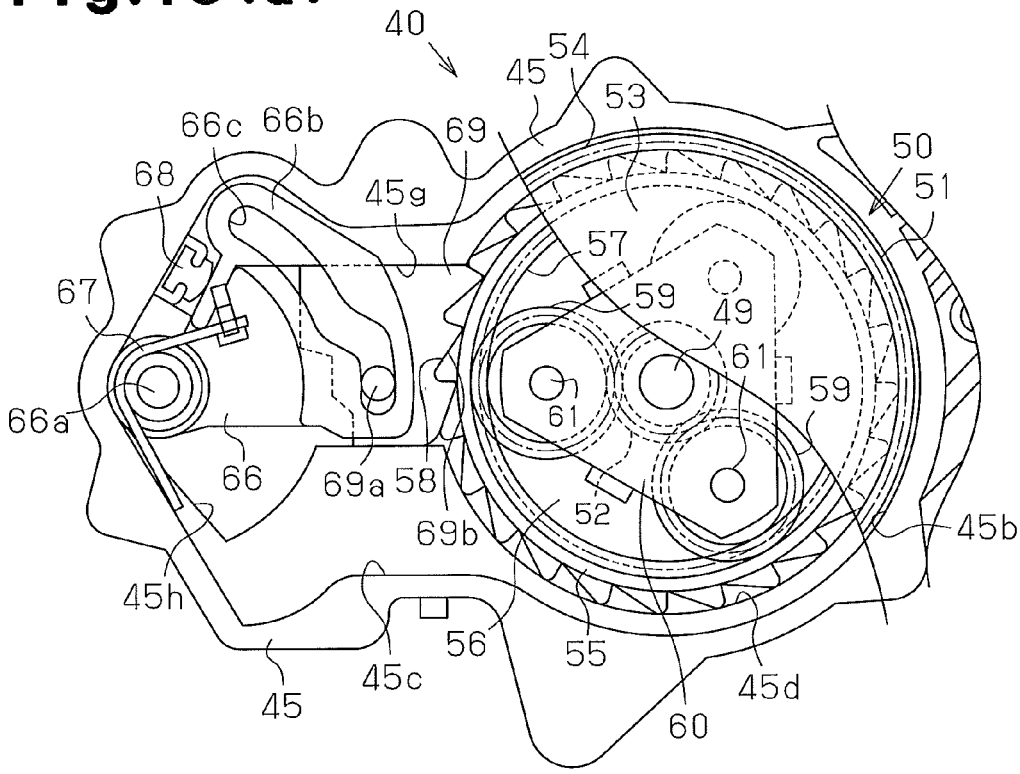
FIGS. 13(*a*) and 13(*b*) are rear views each showing the actuator of FIG. 10.
Figure 13B:
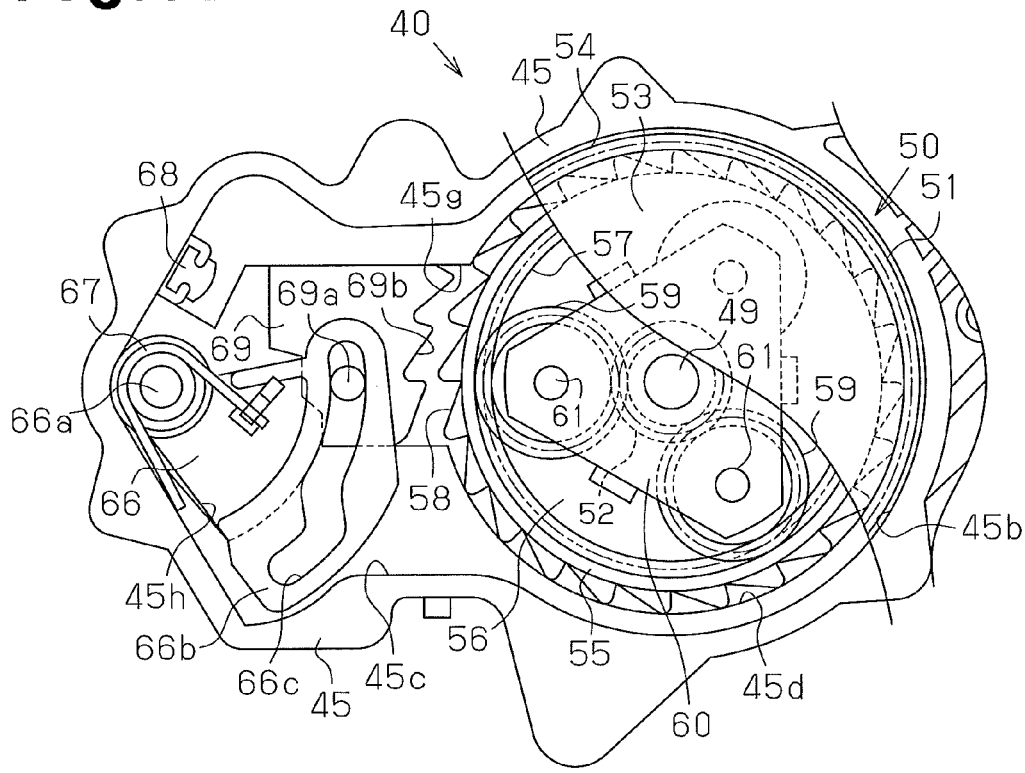

With reference to FIGS. 13(*a*) and 13(*b*), the housing 44 has a tubular case 45 with a bottom. The case 45 includes a first accommodating portion 45*b* shaped as a bottomed cylinder and a second accommodating portion 45*c* shaped as a bottomed polygonal tube. The first accommodating portion 45*b* has an opening arranged at a side (the left side as viewed in FIGS. 13(*a*) and 13(*b*)) in a radial direction of the first accommodating portion 45*b*. The second accommodating portion 45*c* is arranged continuously from the opening of the first accommodating portion 45*b*. In other words, the bottom wall of the case 45 has a shape formed by combining a circle with a polygonal shape.

A circular recess 45*d*, which has an inner diameter smaller than the inner diameter of the first accommodating portion 45*b*, is formed in the bottom wall of the first accommodating portion 45*b*. An output shaft 49, the axis of which extends along the center line of the first accommodating portion 45*b*, is rotatably passed through the center of the recess 45*d*. As illustrated in FIG. 10, the distal end of the output shaft 49 projects outward from the case 45 (the housing 44).

With reference to FIGS. 13(*a*) and 13(*b*), a sun gear 51 is accommodated in the first accommodating portion 45*b*. The sun gear 51 has a tubular sun gear portion 52 through which the output shaft 49 is passed to be rotatable relative to the sun gear portion 52. A disk-like flange portion 53, which extends radially outward, is formed at a first axial end (the front end in the direction perpendicular to the sheet surface of FIG. 13) of the sun gear portion 52. A tubular worm wheel portion 54, which extends toward a second axial end (the rear end in the direction perpendicular to the sheet surface of FIG. 13) of the sun gear portion 52, is formed along a circumferential portion of the flange portion 53. The worm wheel portion 54 is engaged with a worm that is fixed to a rotary shaft of an electric motor 47 (see FIG. 10), which serves as a drive source fastened and fixed to the case 45. Activation of the electric motor 47 is controlled by a non-illustrated controller in such a manner that the rotary shaft of the electric motor 47 is rotated in a forward direction or a reverse direction.

A ring gear 55 shaped as a bottomed tube, which has an outer diameter smaller than the inner diameter of the worm wheel portion 54, is rotatably supported in the recess 45*d*. The ring gear 55 has an annular bottom wall portion 56 and a tubular ring gear portion 57 extending from a circumferential portion of the bottom wall portion 56 toward a side in the axial direction (the front side in the direction perpendicular to the sheet surface of FIG. 13). A plurality of engagement claws 58 (engagement portions) are formed in an outer circumferential surface of the ring gear portion 57 along the entire circumference of the ring gear portion 57. The engagement claws 58 are spaced apart at predetermined pitches at positions axially offset with respect to the worm wheel portion 54.

A plurality of planetary gears 59, which are engaged with the sun gear portion 52 and the ring gear portion 57, are arranged between the sun gear portion 52 and the ring gear portion 57 and spaced apart at predetermined angular intervals about the sun gear portion 52. In the present embodiment, three planetary gears 59 are arranged. A carrier 60 is fixed to the output shaft 49 at such an axial position that the carrier 60 slidably contacts a distal surface of the sun gear portion 52. A support shaft 61, both ends of which are supported by the carrier 60, is passed through each one of the planetary gears 59 in the axial direction of the planetary gear 59. Each planetary gear 59 is rotatable about the associated support shaft 61. That is, the planetary gears 59 are rotatable about the associated support shafts 61 and, while rotating, the planetary gears 59 revolve about the output shaft 49 along the ring gear portion 57. Simultaneously, the carrier 60 rotates integrally with the output shaft 49.

The sun gear 51 (the sun gear portion 52), the ring gear 55 (the ring gear portion 57), the planetary gears 59, and the carrier 60 configure a planetary gear mechanism 50.

As illustrated in FIG. 10, a motor lever 62 is fixed to a distal portion of the output shaft 49 projecting outward from the housing 44. The motor lever 62 has an arcuate guide surface 62*a* and a pair of guide plates 62*b*, which are arranged on the opposite sides of the guide surface 62*a*. The motor lever 62 as a whole has a semi-circular shape. The end 35*b* of the outer tube 35 of the closer cable 34 is held by the bracket 41 at a side of the motor lever 62 (the left side as viewed in FIG. 10). The guide plates 62*b* hold a second end 36*b* of the drive wire 36, which is extended out of the end 35*b* and guided by the guide surface 62*a*.

In the present embodiment, an elongated hole 62*c* extending along the guide surface 62*a* is formed in the guide plates 62*b*. The second end 36*b* of the drive wire 36 is held by the guide plates 62*b* to be movable in the elongated hole 62*c*. When the motor lever 62, together with the output shaft 49, is pivoted in a counterclockwise direction (corresponding to the first direction) of FIG. 10, the drive wire 36 is extended out of the end 35*b* of the outer tube 35. At this stage, the drive wire 36 held by the operating lever 31 is retracted into the end 35*a* of the outer tube 35.

A drive lever 81, which is formed by a plate, is fixed to the distal portion of the output shaft 49 in such a manner that the drive lever 81 pivots integrally with the motor lever 62. A switch cam lever 82 is connected to the bracket 41 in such a manner that the switch cam lever 82 pivots about a pivot axis different from the pivot axis of the drive lever 81. A cam portion 82*a* is formed in a longitudinal central portion of the switch cam lever 82, which is located close to the drive lever 81. The cam portion 82*a* is arranged on the pivotal path of the drive lever 81. Accordingly, when the drive lever 81 pivots in a clockwise direction (corresponding to the second direction) of FIG. 10 together with the motor lever 62, the cam portion 82*a* is pressed by the drive lever 81 in such a manner as to pivot the switch cam lever 82 in the first direction. In other words, the switch cam lever 82 switches the rotating direction of the drive lever 81 (the motor lever 62) to the opposite direction.

The urging force of the lever urging spring, which returns the operating lever 31 to the predetermined pivotal position, is transmitted to the motor lever 62 through the closer cable 34 (the drive wire 36). This maintains the drive lever 81 at the predetermined initial position illustrated in FIG. 10 integrally with the motor lever 62.

A torsion spring 83 is wound around the pivotal shaft of the switch cam lever 82. An end of the torsion spring 83 is hooked to the bracket 41 and the other end of the torsion spring 83 is hooked to the switch cam lever 82. The switch cam lever 82 is urged by the torsion spring 83 to pivot in the second direction and contacts a lever stopper 84 formed in the bracket 41. This restricts pivot of the switch cam lever 82 in the second direction, thus maintaining the switch cam lever 82 at the predetermined pivotal position. A clearance is defined between the cam portion 82*a* of the switch cam lever 82 maintained at the predetermined pivotal position and the drive lever 81 maintained at the predetermined initial position. A free movement range is set from the point at which the drive lever 81 starts to pivot in the second direction to the point at which the drive lever 81 contacts the cam portion 82*a*. Further, when the drive lever 81 (along with the motor lever 62) pivots in the second direction starting from the predetermined initial position, the second end 36*b* of the drive wire 36 is moved in the elongated hole 62*c*, thus preventing the drive wire 36 from being retracted into the end 35*b* of the outer tube 35. The drive lever 81 is shaped in such a manner that, when the drive lever 81 pivots in the first direction starting from the initial position, the drive lever 81 moves freely without interfering with the switch cam lever 82.

An end 28*b* of an outer tube 28 of the releasing cable 27 is held by the bracket 41 in the vicinity of the end 35*b* of the outer tube 35. A distal portion 82*b* of the switch cam lever 82 holds an end 29*b* of the drive wire 29, which extends out of the end 28*b*. When the switch cam lever 82 pivots in the first direction in the above-described manner, the drive wire 29 is pulled out of the end 28*b*. In this state, the drive wire 29, which is held by the lift lever 15, is retracted into the end 28*a*. Specifically, the cam portion 82*a*, which is engaged with the drive lever 81, is located closer to the pivot axis than the distal portion 82*b* of the switch cam lever 82, with which the end 29*b* of the drive wire 29 is engaged, in order to improve the response of transmission of the releasing cable 27 by setting of the leverage ratio of these levers.

An initial position switch 85, which detects the state of the drive lever 81 returned to the predetermined initial position, and a limit switch 86, which detects a full stroke of the drive lever 81 in the second direction, are arranged in the bracket 41.

As illustrated in FIGS. 13(*a*) and 13(*b*), the second accommodating portion 45*c* has a rectangular guide groove 45*g* and an arcuate lever recess 45*h*. The guide groove 45*g* extends continuously from one side (the left side as viewed in FIG. 13) of a radial direction of the recess 45*d* and parallel with the radial direction of the recess 45*d*. The lever recess 45*h* is formed continuously from the distal end of the guide groove 45*g*. A proximal end of a lever shaft portion 66*a*, which is formed integrally with the canceling lever 66 (a canceling mechanism), is rotatably received in the lever recess 45*h*. A distal portion of the lever shaft portion 66*a* projects outward from the case 45 (the housing 44) (see FIG. 10). The canceling lever 66 has an arcuate lever portion 66*b* extending toward the guide groove 45*g*. The lever portion 66*b* is arranged at such a position that the lever portion 66*b* does not interfere with the guide groove 45*g*. An elongated cam hole 66*c* is formed in a distal portion of the lever portion 66*b*. The cam hole 66*c* is bent in such a manner that the end (located forward in a clockwise direction in FIGS. 13(*a*) and 13(*b*)) of the cam hole 66*c* at one circumferential side is arranged closer to the lever shaft portion 66*a* than the end (located forward in a counterclockwise direction in FIGS. 13(*a*) and 13(*b*)) of the cam hole 66*c* at the other circumferential side.

A lever urging spring 67 is wound around the lever shaft portion 66*a*. The proximal end of the lever urging spring 67 is hooked to a first inner wall surface of the second accommodating portion 45*c*, which is the inner wall surface located forward in the clockwise direction in FIGS. 13(*a*) and 13(*b*). The distal end of the lever urging spring 67 is hooked to the canceling lever 66. Accordingly, the canceling lever 66 is urged to pivot in the counterclockwise direction in FIG. 13(*a*). A lever stopper 68, which is arranged in a second inner wall surface of the second accommodating portion 45*c*, that is, the inner wall surface located forward in the counterclockwise direction in FIGS. 13(*a*) and 13(*b*), is held in contact with the facing surface of the lever portion 66*b*. This restricts pivot of the canceling lever 66 in the counterclockwise direction in FIGS. 13(*a*) and 13(*b*), thus maintaining the canceling lever 66 at a predetermined pivotal position.

A plate-like cancel gear 69 (an engagement/disengagement member), which is movable in the guide groove 45*g* along a radial direction of the recess 45*d*, is mounted in the guide groove 45*g*. The cancel gear 69 has an engagement pin 69*a*, which is passed through the cam hole 66*c*. A plurality of gear engagement claws 69*b* are formed in a distal portion of the cancel gear 69 located closer to the recess 45*d*. The gear engagement claws 69*b* are engageable with the engagement claws 58 of the ring gear portion 57, which are exposed in the guide groove 45*g*. As illustrated in FIG. 13(*a*), when the lever stopper 68 is held in contact with the facing surface of the lever portion 66*b* and the canceling lever 66 is maintained at the predetermined pivotal position, the cancel gear 69 moves toward the recess 45*d*, together with the engagement pin 69*a* engaged with the cam hole 66*c*, thus engaging the gear engagement claws 69*b* with the corresponding engagement claws 58 of the ring gear 55. In this state, the ring gear 55 is stopped in a non-rotatable state. Contrastingly, as illustrated in FIG. 13(*b*), when the canceling lever 66 is pivoted in the clockwise direction in FIG. 13(*b*) against the lever urging spring 67, the cancel gear 69 moves toward the lever shaft portion 66*a* together with the engagement pin 69*a*, which is engaged with the cam hole 66*c*, thus disengaging the gear engagement claws 69*b* from the engagement claws 58 of the ring gear 55. In this state, the ring gear 55 is in a rotatable state.

As illustrated in FIG. 10, a lever 70, which is formed by a plate, is fixed to a distal portion of the lever shaft portion 66*a* projecting outward from the housing 44 (the case 45). An end 72*a* of an outer tube 72 of a cancel cable 71 (a canceling mechanism) is held by the housing 44 in the vicinity of the lever 70. The lever 70 holds a proximal end 73*a* of a wire 73 extending out of the end 72*a*. Accordingly, when the wire 73 is retracted into the end 72*a* of the outer tube 72, the lever 70, together with the canceling lever 66, pivots in a counterclockwise direction in FIG. 10, that is, the clockwise direction in FIGS. 13(*a*) and 13(*b*), against the lever urging spring 67. When the vehicle door 1 is in the unlocked state and the manipulation force of the door handle 4, 5 is transmitted to the wire 73 (the cancel cable 71), the wire 73 is retracted into the end 72*a* of the outer tube 72 in such a manner that the lever 70 pivots in the counterclockwise direction in FIG. 10.

Operation of the actuator 40 will now be explained. When the ring gear 55 is held in the non-rotatable state through engagement between the engagement claws 58 and the gear engagement claws 69*b* and the electric motor 47 is activated to transmit the rotation power in the clockwise direction in FIGS. 13(*a*) and 13(*b*) to the sun gear 51 (the worm wheel portion 54), which is fixed to the rotary shaft of the electric motor 47, the sun gear portion 52 is rotated in the clockwise direction in FIGS. 13(*a*) and 13(*b*). The planetary gears 59 thus each rotate in the counterclockwise direction in FIGS. 13(*a*) and 13(*b*) and revolve in the clockwise direction in FIGS. 13. The carrier 60 (the output shaft 49) outputs the rotation power in the clockwise direction in FIGS. 13. In other words, the planetary gear mechanism 50 constitutes a deceleration mechanism having an input shaft, a fixed shaft, and an output shaft formed by the sun gear 51, the ring gear 55, and the carrier 60, respectively. In this state, as the output shaft 49 rotates, the motor lever 62 (together with the drive lever 81) pivots in the counterclockwise direction in FIG. 10, thus pulling the drive wire 36 out of the end 35*b* of the outer tube 35.

Similarly, when the ring gear 55 is held in the non-rotatable state by the engagement between the engagement claws 58 and the gear engagement claws 69*b*, and the electric motor 47 is activated to transmit the rotation power in the counterclockwise direction in FIGS. 13(*a*) and 13(*b*) to the sun gear 51 (the worm wheel portion 54), which is fixed to the rotary shaft of the electric motor 47, the drive lever 81, integrally with the motor lever 62, is pivoted in the clockwise direction in FIG. 10. In this state, the drive lever 81 presses the cam portion 82*a*, thus pivoting the switch cam lever 82 in the counterclockwise direction in FIG. 10. The drive wire 29 is thus pulled out of the end 28*b* of the outer tube 28.

In both cases, the ring gear 55 receives the rotation force in the counterclockwise direction in FIGS. 13(*a*) and 13(*b*) caused by the reactive force to the rotation of the carrier 60 (the output shaft 49). However, the cancel gear 69 reliably restricts rotation of the ring gear 55 caused by the rotation force.

When the engagement claws 58 are disengaged from the gear engagement claws 69*b* and the ring gear 55 is in a rotatable state, the rotation power is not transmitted from the carrier 60 (the output shaft 49). Specifically, the ring gear 55 is rotated only by the rotation power transmitted from the sun gear 51 to the planetary gears 59. In this state, the planetary gears 59 do not revolve and the carrier 60 is prevented from rotating.

As illustrated in FIG. 6, the body portion 11 holds the end 72*b* of the outer tube 72 of the cancel cable 71 at a position below the canceling lever 76 (the attachment piece 76*b*). The attachment piece 76*b* holds a distal end 73*b* of the wire 73, which is extended out of the end 72*b* of the outer tube 72. Accordingly, as illustrated in FIG. 8, when the canceling lever 76 is pivoted about the pivot axis of the canceling lever 76 in the counterclockwise direction in FIG. 8, the wire 73 is pulled out of the end 72*b* of the outer tube 72. In this state, the wire 73, which is held at the side corresponding to the lever 70, is retracted into the end 72*a*. This pivots the canceling lever 66 about the lever shaft portion 66*a* against the lever urging spring 67. The gear engagement claws 69*b* of the cancel gear 69 are thus disengaged from the engagement claws 58 of the ring gear 55, switching the ring gear 55 to the rotatable state. In other words, as long as the vehicle door 1 is in the unlocked state, the manipulation force of the door handle 4, 5 is transmitted to the canceling lever 76 through the open link 14 in such a manner as to raise the attachment piece 76*b*, regardless of which of the door handles 4, 5 is manipulated. The ring gear 55 is thus switched to the rotatable state, and the carrier 60 (the output shaft 49) is prevented from outputting the rotation power. Simultaneously, the manipulation force is transmitted to the lift lever 15 through the canceling lever 76 in such a manner as to pivot the lift lever 15 about the pivot axis of the lift lever 15 in the counterclockwise direction in the drawing. Accordingly, the pole 24, which pivots integrally with the lift lever 15, disengages the engagement end 24*a* from the first engagement portion 21*d* or from the second engagement portion 21*e*. In this state, as has been described, the vehicle door 1 is in the openable state.

The operation of the present embodiment will now be described as a whole.

Assume that the vehicle door 1 is in the unlocked state, that the vehicle door 1 is in the ajar state or the fully closed state, and that the latch mechanism 20 is in the half-latched state or the fully latched state as illustrated in FIG. 4 or FIG. 5. In this state, if the outside door handle 4 is manipulated to open the vehicle door 1, the manipulation force of the outside door handle 4 is transmitted to the open lever 12. This pivots the open lever 12 in the clockwise direction in FIG. 3, thus lifting the second end 12*b*. As the second end 12*b* rises, the open link 14, which is illustrated in FIG. 6, moves upward. This causes the flange 14*a* of the open link 14 to press the canceling pressing portion 76*a* of the canceling lever 76 upward from below. The canceling pressing portion 76*a* thus presses the engagement piece 15*a* of the lift lever 15 upward from below. This pivots the lift lever 15, thus pivoting the pole 24, which pivots integrally with the lift lever 15, in the clockwise direction in FIG. 4 or FIG. 5. The engagement end 24*a* is thus disengaged from the first engagement portion 21*d* or from the second engagement portion 21*e*. Accordingly, the latch 21 is pivoted in the clockwise direction in FIG. 4 or FIG. 5 by the urging force of the latch urging spring 22 in such a manner that the inner wall surface of the engagement recess 21*a* presses the striker 3. This disengages the engagement recess 21*a* from the striker 3, thus switching the vehicle door 1 to the openable state.

When the inside door handle 5 is manipulated to open the vehicle door 1, the inside open lever presses the flange 14*a* of the open link 14 upward from below. This raises the open link 14, thus pivoting the pole 24 together with the lift lever 15 in the above-described manner. Accordingly, in the same manner as the above-described manner, the vehicle door 1 is switched to the openable state.

[Closer Operation]

Assume that the vehicle door 1 is in the unlocked state or the locked state, that the vehicle door 1 is in the ajar state, and that the latch mechanism 20 is in the half-latched state as illustrated in FIG. 4. Further, without manipulation of either door handle 4, 5 to open the vehicle door 1, the ring gear 55 is stopped in the non-rotatable state as illustrated in FIG. 13(*a*) by engagement between the engagement claws 58 and the gear engagement claws 69*b*. In this state, if the electric motor 47 is activated to transmit the rotation power in the clockwise direction in FIGS. 13(*a*) and 13(*b*) to the sun gear 51 (the worm wheel portion 54), the carrier 60 (the output shaft 49) outputs the rotation power in the clockwise direction in FIGS. 13(*a*) and 13(*b*) in the above-described manner. This pivots the drive lever 81 (together with the motor lever 62) in the first direction (the counterclockwise direction in FIG. 10) from the predetermined initial position illustrated in FIG. 10, which is the starting point. The drive wire 36 is thus pulled out of the end 35*b* of the outer tube 35 and retracted into the end 35*a* (see FIGS. 5 and 11). Accordingly, the operating lever 31 pivots in the clockwise direction in FIG. 4, thus pulling the striker 3 engaged with the engagement recess 21*a* in the above-described manner. This switches the latch mechanism 20 to the fully latched state, so that the vehicle door 1 is operated to close from the ajar state to the fully closed state.

When the fully closed state of the vehicle door 1 is detected, the activation of the electric motor 47 is stopped. The operating lever 31 is thus urged by the aforementioned lever urging spring, pulls the drive wire 36 out of the end 35*a*, and pivots in the counterclockwise direction in FIG. 6. This returns the operating lever 31 to the predetermined pivotal position at which pivot of the operating lever 31 is restricted by the lever stopper 32, and the operating lever 31 is maintained at this position. Simultaneously, the urging force of the lever urging spring that acts to return the operating lever 31 to the predetermined pivotal position is transmitted to the motor lever 62 as tensile force of the closer cable 34 (the drive wire 36). This returns the drive lever 81 to the predetermined initial position illustrated in FIG. 10 integrally with the motor lever 62. As has been described, the drive lever 81 is prevented from interfering with the switch cam lever 82 while pivoting in the above-described closer operation.

The fully closed state of the vehicle door 1 is detected by a switch arranged in the latch mechanism 20. Specifically, the fully closed state of the vehicle door 1 is detected using a pole switch and a latch switch. When the latch mechanism 20 is in the fully latched state or the half-latched state, the pole switch determines that the latch mechanism 20 is in the fully latched state or the half-latched state based on the fact that the pole 24 has separated from the latch mechanism 20. The latch switch is formed by a rotary encoder that detects the rotating angle of the latch 21.

[Canceling Operation]

Assume that either one of the door handles 4, 5 is manipulated to open the vehicle door 1 when the electric motor 47 is running, that is, when the vehicle door 1 is operated to close. If the vehicle door 1 is in the unlocked state, the open link 14 rises to cause the flange 14*a* to press the canceling pressing portion 76*a*. This pivots the canceling lever 76 about the pivot axis of the canceling lever 76 in the clockwise direction in FIG. 6, thus raising the attachment piece 76*b* (see FIG. 8). The wire 73 is thus pulled out of the end 72*b* of the outer tube 72 and retracted into the end 72*a* of the outer tube 72, which is illustrated in FIG. 10. As a result, the canceling lever 66 pivots in the clockwise direction in FIG. 13 integrally with the lever 70, thus disengaging the gear engagement claws 69*b* of the cancel gear 69 from the corresponding engagement claws 58 of the ring gear 55 in the above-described manner. The ring gear 55 is thus switched to the rotatable state. Further, the output of the rotation power from the carrier 60 (the output shaft 49) is stopped. The latch mechanism 20 may be switched to the unlatched state by manipulating the door handle 4, 5. In this state, the power transmission through the planetary gear mechanism 50 is blocked. Accordingly, the operating lever 31, which has been engaged with the latch 21 (the follower projection 21*f*) to switch the latch mechanism 20 from the half-latched state to the fully latched state, permits the latch mechanism 20 to be switched to the unlatched state. As a result, the vehicle door 1 is switched to the openable state.

If the manipulation force of the door handle 4, 5 is canceled in this state, the canceling lever 66 is urged by the lever urging spring 67 and returns to the predetermined pivotal position. The cancel gear 69 thus moves along the guide groove 45*g* in such a manner that the gear engagement claws 69*b* of the cancel gear 69 become engaged with the corresponding engagement claws 58 of the ring gear 55. This stops and maintains the ring gear 55 in the non-rotatable state again. Further, the lever 70 is pivoted in the clockwise direction in FIG. 10 as the canceling lever 66 is pivoted. The wire 73 is thus pulled out of the end 72*a* and retracted into the end 72*b* illustrated in FIG. 6. As a result, by pivoting in the counterclockwise direction in FIG. 8, the canceling lever 76 is returned to and maintained at the predetermined pivotal position illustrated in FIG. 6.

If the vehicle door 1 has been held in the locked state when either one of the door handles 4, 5 is manipulated to open the vehicle door 1 during the operation of the electric motor 47 is in operation, that is, during the closing operation of the vehicle door 1, and, the above-described canceling operation is effectuated by switching the vehicle door 1 to the unlocked state by activating the aforementioned actuator used in switching of the open link 14. Afterwards, the vehicle door 1 may be re-switched (returned) to the locked state by activation of the actuator.

[Releasing Operation]

Assume that the vehicle door 1 is in the locked state and the ajar state or the fully closed state and that the latch mechanism 20 is in the half-latched state or the fully latched state illustrated in FIG. 4 or FIG. 5. In this state, either one of the door handles 4, 5 is not manipulated to open the vehicle door 1, and the ring gear 55 is held in the non-rotatable state by engagement between the engagement claws 58 and the gear engagement claws 69*b* (see FIG. 13(*a*)). If, in this state, the electric motor 47 is activated to output the drive force acting in the second direction from the actuator 40 and the rotation power in the counterclockwise direction in FIGS. 13(*a*) and 13(*b*) is transmitted to the sun gear 51 (the worm wheel portion 54), the carrier 60 (the output shaft 49) outputs the rotation power in the counterclockwise direction in FIGS. 13(*a*) and 13(*b*) in the above-described manner. This pivots the drive lever 81 integrally with the motor lever 62 in the second direction from the predetermined initial position illustrated in FIG. 10, which is the starting point. The drive lever 81 thus presses the cam portion 82*a*, thus pivoting the switch cam lever 82 in the first direction. Accordingly, the drive wire 29 is pulled out of the end 28*b* of the outer tube 28 and retracted into the end 28*a* (see FIGS. 7 and 12). This pivots the lift lever 15 in the counterclockwise direction in FIG. 6 integrally with the pole 24 without moving the canceling lever 76. The engagement end 24*a* is thus disengaged from the first engagement portion 21*d* or the second engagement portion 21*e* in the above-described manner. As a result, the vehicle door 1 disengages the striker 3 from the engagement recess 21*a* and is switched to the openable state.

After the vehicle door 1 is completely switched to the openable state, the limit switch 86 detects the full stroke of the drive lever 81 in the second direction (the clockwise direction in FIG. 12). This activates the electric motor 47 in the reverse direction in such a manner that the motor lever 62 and the drive lever 81, which pivot integrally with the output shaft 49 (the carrier 60), pivot in the first direction (the counterclockwise direction in FIG. 12). The drive lever 81 is thus returned to the predetermined initial position illustrated in FIG. 10. In this state, since the second end 36*b* of the drive wire 36 (the closer cable 34) is allowed to move in the elongated hole 62*c*, the drive wire 36 (the closer cable 34) is prevented from being retracted into the end 35*b* of the outer tube 35. The switch cam lever 82 is thus urged by the torsion spring 83 to pivot in the second direction (the clockwise direction in FIG. 12) and returned to and maintained at the predetermined pivotal position at which pivot of the switch cam lever 82 is restricted by the lever stopper 84. Further, the lift lever 15 is urged by the pole urging spring 26 together with the pole 24 to pull the drive wire 29 out of the end 28*a* and pivot in the clockwise direction in FIG. 7. As a result, the lift lever 15 is returned to and maintained at the predetermined pivotal position at which pivot of the pole 24 is restricted by the pole stopper 25.

Particularly, when the vehicle door 1 is in the locked state, the open link 14 (the flange 14*a*) is prevented from contacting the canceling lever 76 (the canceling pressing portion 76*a*) regardless of the state of the latch mechanism 20. Accordingly, for example, if the door handle 4, 5 is manipulated when the vehicle door 1 is being switched from the locked state to the unlocked state by activation of the aforementioned actuator used in switching of the open link 14, the releasing operation based on the above-described operation of the canceling lever 76 (the power transmission between the electric motor 47 and the drive lever 81) is not suspended. The releasing operation is thus carried out continuously regardless of manipulation of the door handle 4, 5. Further, when the pole 24 (together with the lift lever 15) is pivoted as the vehicle door 1 is operated to close, the canceling lever 76 is prevented from pivoting. This prevents buckling of the cancel cable 71.

FIG. 15 represents the above-described relationships between the operations (the canceling operation, the closer operation, and the releasing operation) of the present embodiment and the states (the locked state and the unlocked state) of the vehicle door 1. Effectuation and non-effectuation of each one of the operations are indicated by a circle and a cross, respectively. Further, a triangle indicates that the canceling operation in the locked state is effectuated by switching the vehicle door 1 to the unlocked state and then returning the vehicle door 1 to the locked state.

The present embodiment has the advantages described below as has been explained in detail.

(1) In the present embodiment, the latch mechanism 20 is switched from the half-latched state to the fully latched state by pivoting the drive lever 81 in the first direction from the predetermined initial position, which is the starting point, by the electric motor 47 of the actuator 40 (the closer operation). By pivoting the drive lever 81 in the second direction from the initial position, the starting point, the latch mechanism 20 is switched from the fully latched state or the half-latched state to the unlatched state (the releasing operation). In this manner, without providing an additional actuator 40 (an additional electric motor 47 or an additional drive lever 81), the closer operation and the releasing operation are both carried out by means of the actuator 40 (the electric motor 47 and the drive lever 81). In other words, the closer operation and the releasing operation are both performed by the single actuator 40.

Further, only when the vehicle door 1 is held in the unlocked state by the open link 14 (the locking mechanism), the power transmission between the electric motor 47 and the drive lever 81 is blocked by transmitting the manipulation force of the door handle 4, 5 to the canceling lever 76 (the canceling mechanism) through the open link 14 (the canceling operation). Accordingly, by canceling the closer operation through manipulation of the door handle 4, 5, the vehicle door 1 is prevented from catching an object.

When the vehicle door 1 is held in the locked state by the open link 14 (the locking mechanism) and the door handle 4, 5 is manipulated before the vehicle door 1 is switched to the unlocked state (the panic state), the manipulation force of the door handle 4, 5 is not transmitted to the canceling lever 76 through the open link 14 unless the vehicle door 1 is completely switched to the unlocked state. Accordingly, since the power transmission between the electric motor 47 and the drive lever 81 is prevented from stopping, the actuator 40 performs, for example, the releasing operation continuously regardless of manipulation of the door handle.

(2) In the present embodiment, pivot of the drive lever 81 in the second direction from the predetermined initial position, which is the starting point, is transmitted to the latch mechanism 20 via the switch cam lever 82, which is engaged with the drive lever 81 at the cam portion 82*a*. This switches the latch mechanism 20 from the fully latched state or the half-latched state to the unlatched state. Accordingly, even if the initial position, which is the starting point, of the drive lever 81 is varied, such variation is effectively absorbed by setting a dead zone between the drive lever 81 and the engaged cam portion 82*a* until the latch mechanism 20 starts to operate.

Further, when the switch cam lever 82 pivots as the drive lever 81 pivots, the movement amount (the stroke) of the joint portion (the distal portion 82*b*) between the switch cam lever 82 and the latch mechanism 20 is amplified with respect to the movement amount of the cam portion 82*a* in correspondence with the leverage ratio. This improves the response of the releasing operation.

(3) In the present embodiment, the pivotal direction of the switch cam lever 82 used in the releasing operation is the same as the pivotal direction of the drive lever 81 (the motor lever 62) used in the closer operation. Accordingly, in both of the releasing operation and the closer operation, the latch mechanism 20 is actuated by similar transmission structures (cables that are selectively pulled out and in) using pivot of the switch cam lever 82 and pivot of the drive lever 81 in the same directions.

(4) In the present embodiment, the planetary gear mechanism 50 is employed to transmit rotation of the electric motor 47 to the drive lever 81. Further, the power transmission from the electric motor 47 to the drive lever 81 is selectively permitted and prohibited by the cancel gear 69, which has an extremely simple configuration and selectively permits and prohibits rotation of the ring gear 55.

(5) In the present embodiment, the canceling lever 76 is arranged coaxially with the lift lever 15 used in the releasing operation. This reduces the space for installing the canceling lever 76. Further, the canceling lever 76 switches the latch mechanism from, for example, the fully latched state or the half-latched state to the unlatched state by pressing the engagement piece 15*a* of the lift lever 15 by means of the canceling pressing portion 76*a* so as to pivot the lift lever 15 (the pole 24) in the canceling operation. Also, since the canceling lever 76 is permitted to pivot relative to the lift lever 15, the canceling lever 76 is capable of allowing the lift lever 15 to pivot independently without following pivot of the lift lever 15. The canceling lever 76 is thus prevented from hampering the releasing operation.

(6) In the present embodiment, the canceling lever 76 has a simple configuration including only the plate-like canceling pressing portion 76*a*, which is engaged with the open link 14 (the flange 14*a*) and the lift lever 15 (the engagement piece 15*a*).

(7) In the present embodiment, a necessary pivot amount (stroke) of the canceling lever 76 is ensured by amplifying the pivot amount (the stroke) of the drive lever 81 using the switch cam lever 82, without increasing the pivot amount of the drive lever 81. This facilitates installation of the vehicle door opening/closing device in the vehicle door 1, which has a limited space.

The above-described embodiment may be modified to the forms described below.

In the above-described embodiment, any suitable transmission member (such as a lever) that becomes engaged with the open link 14 so as to switch the open link 14 may be employed as the locking mechanism that transmits the manipulation force of the door handle 4, 5 to the canceling mechanism. If the actuator used in switching of the open link 14 is an electromagnetic solenoid, the output rod of the solenoid, which selectively projects and retracts, may be employed as the locking mechanism.

In the above-described embodiment, the operating lever 31 of the door latch device 10 and the drive lever 81 (the motor lever 62) of the actuator 40 are connected to each other with the closer cable 34 so as to transmit the drive force. However, the operating lever 31 and the drive lever 81 (the motor lever 62) may be directly connected to each other with a gear, or may be connected to each other with a link or a cam, in order to transmit the drive force.

In the above-described embodiment, the lift lever 15 of the door latch device 10 and the drive lever 81 of the actuator 40 are connected to each other with the switch cam lever 82 and the releasing cable 27 in order to transmit the drive force. However, the lift lever 15 and the drive lever 81 may be directly connected to each other with a gear, or may be connected to each other with a link, so as to transmit the drive force.

In the above-described embodiment, the canceling lever 76 used in manipulation of the door handles 4, 5 and the lever 70 of the actuator 40 are connected to each other with the cancel cable 71 in order to transmit the manipulation force. However, the canceling lever 76 and the lever 70 may be directly connected to each other directly with a gear, or may be connected to each other with a link or a cam, so as to transmit the manipulation force.

The invention claimed is:

1. A vehicle door opening/closing device comprising:

a latch mechanism that is switchable among a fully latched state, in which the latch mechanism holds a vehicle door in a fully closed state, a half-latched state, in which the latch mechanism holds the vehicle door in an ajar state, and an unlatched state, in which the latch mechanism does not hold the vehicle door;

a locking mechanism capable of switching the vehicle door between a locked state and an unlocked state;

a pivotable operating lever;

a drive unit having a drive source and a pivotable drive lever, the drive lever being connected to the operating lever with a drive force transmitting member, the drive source pivots the drive lever in a first direction from a predetermined initial position serving as a starting point to transmit a drive force to the operating lever through the drive force transmitting member so that the operating lever pivots to be engaged with the latch mechanism, thereby switching the latch mechanism from the half-latched state to the fully latched state, the drive source transmitting the drive force to the latch mechanism by pivoting the drive lever in a second direction opposite to the first direction from the predetermined initial position serving as the starting point, thereby switching the latch mechanism from the fully latched state or the half-latched state to the unlatched state; and a canceling mechanism that operates to block transmission of power between the drive source and the drive lever when a manipulation force of a vehicle door handle is transmitted to the canceling mechanism through the locking mechanism, a releasing lever that is pivoted by the drive lever pivoting in the second direction to be engaged with the latch mechanism, thereby switching the latch mechanism from the fully latched state or the half-latched state to the unlatched state, wherein the manipulation force of the door handle is transmitted to the canceling mechanism only when the vehicle door is in the unlocked state, wherein the canceling mechanism includes a canceling lever that is arranged coaxially with the releasing lever and permitted to pivot relative to the releasing lever, the canceling lever having a pressing portion, the pressing portion being engageable with the locking mechanism and the releasing lever when the vehicle door is in the unlocked state, and wherein, when the vehicle door is in the unlocked state, the manipulation force of the door handle is transmitted to the pressing portion through the locking mechanism in such a manner as to pivot the canceling lever, thereby causing the canceling lever to block the transmission of power between the drive source and the drive lever and causing the pressing portion to press the releasing lever to pivot the releasing lever.

2. The vehicle door opening/closing device according to claim 1, when the vehicle door is in the locked state, the pressing portion cannot be engaged with the locking mechanism, wherein, when the vehicle door is in the locked state, the manipulation force of the door handle is not transmitted to the pressing portion through the locking mechanism so that the canceling lever does not pivot.

3. The vehicle door opening/closing device according to claim 1, wherein the drive unit has a motor lever pivotable integrally with the drive lever, wherein the drive force transmitting member includes a wire connecting the motor lever to the operating lever.

4. A vehicle door opening/closing device comprising:

a latch mechanism that is switchable among a fully latched state, in which the latch mechanism holds a vehicle door in a fully closed state, a half-latched state, in which the latch mechanism holds the vehicle door in an ajar state, and an unlatched state, in which the latch mechanism does not hold the vehicle door;

a locking mechanism capable of switching the vehicle door between a locked state and an unlocked state;

a pivotable operating lever;

a drive unit having a drive source and a pivotable drive lever, the drive lever being connected to the operating lever with a drive force transmitting member, the drive source pivots the drive lever in a first direction from a predetermined initial position serving as a starting point to transmit a drive force to the operating lever through the drive force transmitting member so that the operating lever pivots to be engaged with the latch mechanism, thereby switching the latch mechanism from the half-latched state to the fully latched state, the drive source transmitting the drive force to the latch mechanism by pivoting the drive lever in a second direction opposite to the first direction from the predetermined initial position serving as the starting point, thereby switching the latch mechanism from the fully latched state or the half-latched state to the unlatched state; and a canceling mechanism that operates to block transmission of power between the drive source and the drive lever when a manipulation force of a vehicle door handle is transmitted to the canceling mechanism through the locking mechanism, a cam lever having a cam portion, wherein the manipulation force of the door handle is transmitted to the canceling mechanism only when the vehicle door is in the unlocked state, wherein, when the drive lever pivots in the second direction from the predetermined initial position serving as the starting point, the drive lever becomes engaged with the cam portion in such a manner as to pivot the cam lever, thereby switching the latch mechanism from the fully latched state or the half-latched state to the unlatched state.

5. The vehicle door opening/closing device according to claim 4, when the drive lever pivots in the second direction from the predetermined initial position serving as the starting point, the drive lever becomes engaged with the cam portion in such a manner as to pivot the cam lever in the same direction as the first direction.

6. The vehicle door opening/closing device according to claim 4, wherein the drive unit has a motor lever pivotable integrally with the drive lever, wherein the drive force transmitting member includes a wire connecting the motor lever to the operating lever.

7. A vehicle door opening/closing device comprising:

a latch mechanism that is switchable among a fully latched state, in which the latch mechanism holds a vehicle door in a fully closed state, a half-latched state, in which the latch mechanism holds the vehicle door in an ajar state, and an unlatched state, in which the latch mechanism does not hold the vehicle door;

a locking mechanism capable of switching the vehicle door between a locked state and an unlocked state;

a pivotable operating lever;

a drive unit having a drive source and a pivotable drive lever, the drive lever being connected to the operating lever with a drive force transmitting member, the drive source pivots the drive lever in a first direction from a predetermined initial position serving as a starting point to transmit a drive force to the operating lever through the drive force transmitting member so that the operating lever pivots to be engaged with the latch mechanism, thereby switching the latch mechanism from the half-latched state to the fully latched state, the drive source transmitting the drive force to the latch mechanism by pivoting the drive lever in a second direction opposite to the first direction from the predetermined initial position serving as the starting point, thereby switching the latch mechanism from the fully latched state or the half-latched state to the unlatched state; and a canceling mechanism that operates to block transmission of power between the drive source and the drive lever when a manipulation force of a vehicle door handle is transmitted to the canceling mechanism through the locking mechanism, a sun gear that is driven by the drive source to rotate;

a ring gear that has an engagement portion formed in an outer circumferential surface thereof and is arranged coaxially with the sun gear;

a planetary gear that is engaged with the sun gear and the ring hear, and rotates relative to and revolves about the ring gear when the sun gear rotates; and a carrier that is arranged coaxially with the sun gear and connected to the planetary gear, the carrier rotating integrally with the drive lever as the planetary gear rotates and revolves, wherein the manipulation force of the door handle is transmitted to the canceling mechanism only when the vehicle door is in the unlocked state, wherein the canceling mechanism has an engagement/disengagement member, the engagement/disengagement member becoming engaged with the engagement portion in such a manner that the ring gear cannot rotate, and the engagement/disengagement member becoming disengaged from the engagement portion so as to permit the ring gear to rotate when the manipulation force of the door handle is transmitted to the engagement/disengagement member through the locking mechanism.

8. The vehicle door opening/closing device according to claim 7, wherein the drive unit has a motor lever pivotable integrally with the drive lever, wherein the drive force transmitting member includes a wire connecting the motor lever to the operating lever.

* * * * *